US011344782B2

(12) United States Patent
Gankas

(10) Patent No.: US 11,344,782 B2
(45) **Date of Patent: *May 31, 2022**

(54) SYSTEM AND PROCESS FOR TRAINING A SPORTS SWING

(71) Applicant: George Gankas, Thousand Oaks, CA (US)

(72) Inventor: George Gankas, Thousand Oaks, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/223,990

(22) Filed: Apr. 6, 2021

(65) Prior Publication Data

US 2021/0220716 A1 Jul. 22, 2021

Related U.S. Application Data

(63) Continuation of application No. 17/064,412, filed on Oct. 6, 2020, now Pat. No. 11,027,184.

(60) Provisional application No. 62/923,992, filed on Oct. 21, 2019.

(51) Int. Cl.

| | |
|---|---|
| ***A63B 69/36*** | (2006.01) |
| ***A63B 69/00*** | (2006.01) |
| *A63B 102/32* | (2015.01) |

(52) U.S. Cl.

CPC ..... *A63B 69/0059* (2013.01); *A63B 69/3632* (2013.01); *A63B 2102/32* (2015.10); *A63B 2209/10* (2013.01)

(58) Field of Classification Search

CPC ..... A63B 69/0059; A63B 69/3632; A63B 2102/32; A63B 2209/10

USPC ..... 473/205, 207, 212–214, 219, 227, 266, 473/276, 409

See application file for complete search history.

(56) References Cited

U.S. PATENT DOCUMENTS

| | | | | |
|---|---|---|---|---|
| 4,382,302 | A * | 5/1983 | Watson | A63B 21/065 2/102 |
| 4,688,800 | A * | 8/1987 | Lopez | A63B 69/3608 473/215 |
| 5,240,156 | A | 8/1993 | Sicotte et al. | |
| 5,505,356 | A | 4/1996 | Noriega et al. | |
| 5,836,488 | A * | 11/1998 | Priestley | A45F 5/00 224/222 |
| D482,863 | S * | 12/2003 | Flood | D3/224 |
| 7,686,699 | B2 * | 3/2010 | Snyders | A63B 69/0059 473/216 |
| 7,976,398 | B2 * | 7/2011 | Clawson | A63B 69/0059 473/212 |
| 8,986,139 | B1 * | 3/2015 | Gideon | A63B 69/3608 473/438 |

(Continued)

*Primary Examiner* — Nini F Legesse
(74) *Attorney, Agent, or Firm* — Kelly & Kelley, LLP

(57) ABSTRACT

A system and process for training a user's sports swing to maintain arm position and body rotation so as to promote a proper swing arc. The system includes a waist wrap having one or more attachment area on an outer surface. The system also includes one or more training blocks configured for attachment to the attachment area depending upon the type of swing being practices. The process promotes a proper swing arc by indicating incorrect arm position and/or body rotation through excessive contact between the user's arms and the training blocks during the swing. The goal of the system and process is to train a user's muscle memory for the correct arm position and body rotation in a proper swing arc.

16 Claims, 33 Drawing Sheets

(56) References Cited

U.S. PATENT DOCUMENTS

| | | | | |
|---|---|---|---|---|
| 10,898,776 | B1 * | 1/2021 | Arza | A63B 71/0622 |
| 11,027,184 | B2 * | 6/2021 | Gankas | A63B 69/3676 |
| 2010/0323824 | A1 * | 12/2010 | Gamboa | A63B 69/0059 473/438 |

* cited by examiner

SYSTEM AND PROCESS FOR TRAINING A SPORTS SWING

RELATED APPLICATION

This application is a continuation of U.S. application Ser. No. 17/064,412, filed on Oct. 6, 2020 (now U.S. Pat. No. 11,027,184) which claims the benefit of U.S. Provisional Application No. 62/923,992, filed on Oct. 21, 2019.

BACKGROUND OF THE INVENTION

The present invention is directed to a sports swing training aid. More particularly, the sports swing training aid is designed to encourage proper body rotation and arm position at the top, bottom, and follow through of a sports swing. The training aid was particularly developed in reference to a golf swing, but has application in other sports, for example, baseball, where an athlete relies on repetitive arm swing and/or body rotation movements.

The sport of golf involves swinging a club back and forward through an inclined arc so as to contact a golf ball at the bottom of the arc. Baseball also involves swinging a bat through an arc so as to contact a moving baseball in a particular position in front of the athlete. Accurate positioning of the torso, arms and hands throughout the arc of these swings is critical to make sure that the club or bat contacts the ball in the correct position so that the ball follows the desired trajectory. Improper rotation of the torso and/or positioning of the hands/arms during the swing can make the ball travel a shorter distance and/or cause the ball to travel in other than a desired direction, i.e., with a slice, a hook, a fade, or a draw. An athlete could even miss the ball entirely if the arm position is off by enough.

Through practice and repetition, athletes learn through muscle memory the arc of swing. It is important that such practice and repetition teaches body rotation and places the hands and arms in the proper position, otherwise the muscle memory will reproduce an improper swing. Given the length of an athlete's arms, a slight variation in the positioning of the upper arms can result in a drastic variation in the position of the forearms and hands. Therefore, the positioning of the arms plays a critical role in the positioning of a proper swing arc.

Accordingly there is a need for a sports swing training aid that better allows an athlete to train on the proper rotation of the torso and positioning and placement of his/her arms during the arc of a swing—particularly from the top and bottom of the swing. The present invention fulfills these needs and provides other related advantages.

SUMMARY OF THE INVENTION

The present invention relates to a system and method for training a user in a proper sports swing. The system includes a waist wrap having one or more blocks that are selectively attachable thereto to train a user in proper arm position for various types of sports swings. The method involves a user wearing the waist wrap with appropriate combinations of blocks to train proper arm positioning during a swing based on non-contact with the blocks, or conversely, improper arm positions based on contact with the blocks.

More particularly, the system for training a user in a proper sports swing has a waist wrap with an elongated shape configured for wrapping around a user's waist or torso having an inside surface and an outside surface. The inside surface has at least one waist securing region at one end of the elongated shape. The outside surface has a plurality of securing regions along the elongated shape. The system also includes at least a first training block having a polygonal shape and one attachment face. The attachment face has a matching securing region configured for selective attachment to one of the plurality of securing regions on the outside surface of the waist wrap. The system preferably has a second training block having a polygonal shape and one attachment face with a matching securing region configured for selective attachment to one of the plurality of securing regions on the outside surface of the waist wrap.

At least one of the plurality of securing regions on the outside surface includes at least one waist securing matching region on an opposite end of the elongated shape from the waist securing region on the inside surface. The plurality of securing regions on the outside surface of the waist wrap may be a continuous securing region extending from one end of the elongated shape to an opposite end.

The first training block and second training block may both be a cube shape. The second training block may include a guide face adjacent to the attachment face that includes three guidelines oriented perpendicular to the attachment face.

The system may further include a third securing block having a polygonal shape and one attachment face having a matching securing region configured for selective attachment to one of the plurality of securing regions on the outside surface of the waist wrap. The system may further include a fourth securing block having a polygonal shape and one attachment face having a matching securing region configured for selective attachment to one of the plurality of securing regions on the outside surface of the waist wrap. In the system with four securing blocks, the first, second, and third securing blocks may each have a cube shape with the fourth securing block having a triangular prism shape.

The system may further include a shoulder harness attached to the waist wrap.

The process for training a user in a proper sports swing begins with securing a waist wrap around a waist of the user. At least one training block is attached to a securing region on an outside surface of the waist wrap. The user then practices a swing arc for the particular sports swing being trained. For a golf swing starting at address of a golf ball, the user moves through backswing, downswing, impact, and frontswing (or follow through). The user is trained to maintain proper arm position and body rotation for the golf swing throughout backswing, downswing, impact, and follow through. Proper arm position and body rotation is indicated by an absence of contact between the user's arm and the training block.

For a golf swing, the training block may be attached to a rear lateral securing region on the waist wrap. In this instance, the maintaining step includes an absence of contact between the training block and a rear arm of the user. The training block may also be attached to a front lateral securing region on the waist wrap. In this instance, the maintaining step includes an absence of contact between the training block and a front arm of the user.

The training block attached to the front lateral securing region may have a laterally extending guideline on an upward facing surface. With this laterally extending guideline, the process further includes the step of monitoring body rotation of the user by visually aligning the laterally extending guideline with a vertical line passing through the golf ball during the backswing. Preferably, the training block has three laterally extending guidelines sequentially across the upward facing surface. With three guidelines, the monitoring step includes visually aligning each of the three laterally extending guidelines in sequence with the vertical line passing through the golf ball throughout the backswing.

Alternatively, the training block may be attached to an abdominal securing region on the waist wrap. In this instance, the maintaining step includes an absence of contact between the training block and both a front arm and a rear arm of the user. The process may also include step of attaching a second training block to a second securing region on the outside surface of the waist wrap on a lateral side of the user opposite the training block.

The process further includes repeating the steps of practicing and maintaining for a pre-determined duration.

For a baseball swing, the training block may again be attached to a rear lateral securing region on the waist wrap. In this instance, the maintaining step includes an absence of contact between the training block and a rear arm of the user. The training block may also be attached to a front lateral securing region on the waist wrap, or more preferably adjusted to a diagonal securing position—between a front lateral securing position and an abdominal securing position—on the waist wrap. In this instance, the maintaining step again includes an absence of contact between the training block and a front arm of the user. The waist wrap may also be adjusted higher on the user's torso depending upon the bat swing plane of the user.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
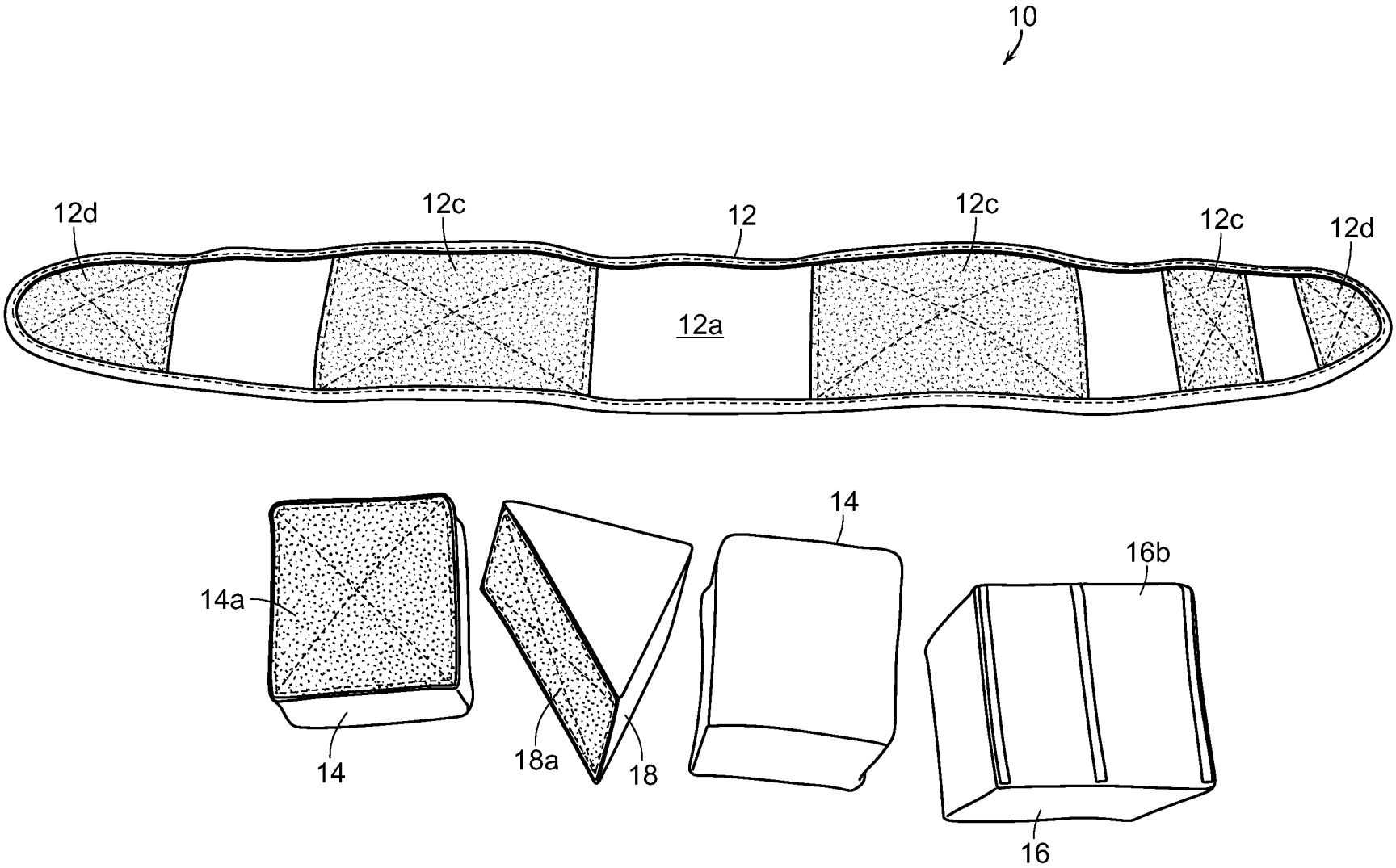
FIG. 1 is a plan illustration of individual components of the inventive sports swing training apparatus.
Figure 1A:
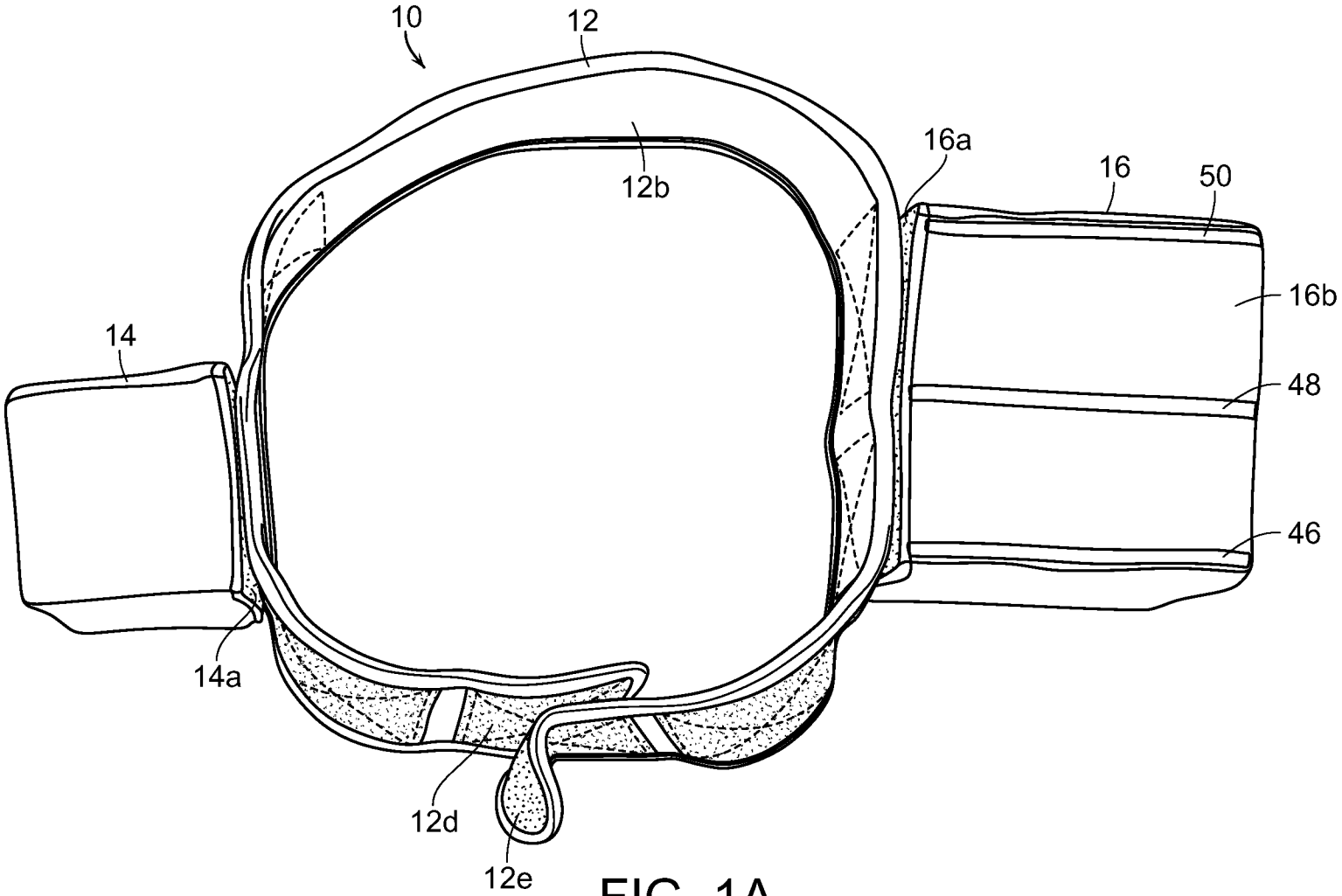
FIG. 1A is a perspective view is select assembled components of a preferred embodiment of the inventive sports swing training apparatus.

The sports swing training apparatus of the present invention, shown in FIGS. 1 and 1A and generally referred to herein by reference numeral 10 consists primarily of a waist wrap 12 having one or more selectively attachable blocks 14, 16, 18. There may be multiple forms of one or more blocks 14, as shown. The waist wrap 12 is a belt or similar structure configured to encircle a user's waist. The waist wrap 12 is preferably elongated in shape having an outer surface 12*a* and in inner surface 12*b*.

The outer surface 12*a* preferably has a plurality of attachment areas 12*c*, including an end attachment area 12*d* at each end. The inner surface 12*b* preferably has an end attachment area 12*e* at least at one end. The attachment areas 12*c*, 12*d*, 12*e* are preferably hook and loop-type material, commercially known as VELCRO®, but may also consist of other known fasteners. The end attachment areas 12*d* and 12*e* are configured to selectively connect to each other so as to form the waist wrap 12 into a loop (FIG. 1A) around a user's waist as described below.

The blocks 14, 16, 18 preferably have at least one attachment surface 14*a*, 16*a*, 18*a*. Each attachment surface 14*a*, 16*a*, 18*a* is preferably hook and loop-type material, commercially known as VELCRO®, or other known fasteners configured for selective attachment and removal to one or more attachment areas 12*c* on the waist wrap 12. The blocks 14, 16, 18 are designed to guide and/or restrict torso rotation and arm movement during a swing arc of a sports swing.

Figure 2:
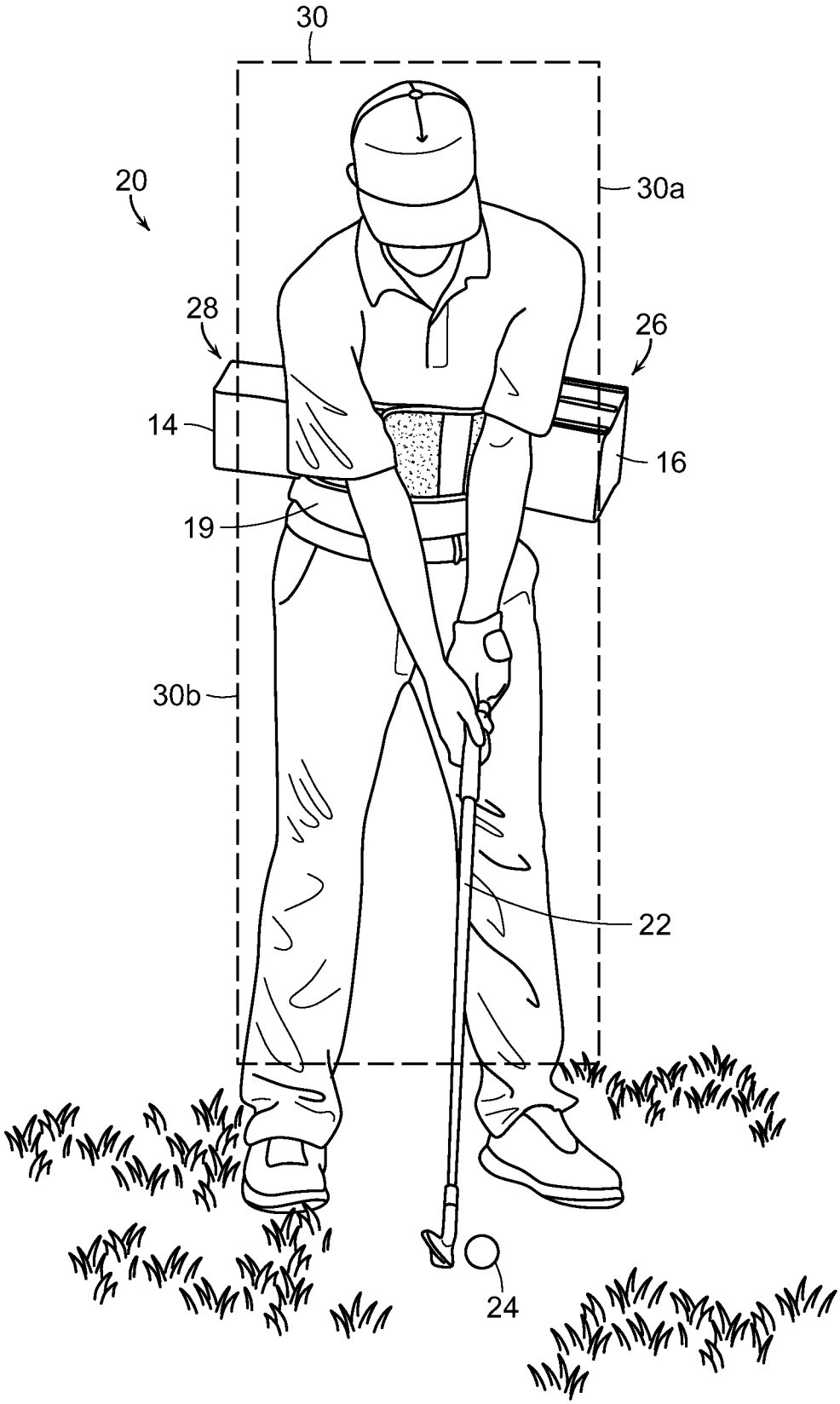
FIG. 2 is a perspective view of the inventive sports swing training apparatus with a user wearing the waist wrap having front lateral and rear lateral swing blocks in an address position for a regular swing.

FIG. 2 shows a user wearing the waist wrap 12 of the system 10 around their waist or torso 19 in a standard address position 20 holding a club 22 addressing a ball 24 in a typical swing. In such a typical swing, at least two of the attachment areas 12*c* are designed to be positioned in a front lateral position 26 and a rear lateral position 28, both above the user's hips. In this description, "front lateral position" refers to a position along a user's side ("lateral") to the front, i.e., in the direction that the user intends to hit the ball. Conversely, "rear lateral position" refers to a position along a user's side ("lateral") to the rear, i.e., away from the direction that the user intends to hit the ball. The "front" and "rear" directions will be on opposite sides of the user depending upon whether the user is left-handed or right-handed.

Lateral seam lines 30*a*, 30*b* may be defined along each side of the user's torso in a lateral plane 30 through the user's body. Each seam line 30*a*, 30*b* preferably passes through one or the other of the front and rear lateral positions 26, 28. Blocks 14, 16, 18 are configured to be removably attached at the front and rear lateral positions 26, 28. The blocks 14, 16, 18, particularly the one attached to the rear lateral position 28 may be position with an anterior face angled slightly backwards, depending upon the user's particular preferences, arm positions, and body style.

The blocks 14, 16 are preferably rectangular or square shaped, i.e., cubes, and may come in various sizes depending on the size of the user and the desired amount of restriction or guidance. The block 16 is preferably also rectangular or square shaped with a guideline surface 16*b* oriented perpendicular to the attachment surface 16*a*. The guideline surface 16*b* includes at least one, but preferably multiple guidelines 16*c* that are used as described more fully below. The third type of block 18 is preferably prism-shaped.

When using the system 10 to train a full swing, the blocks 14, 16, 18 are preferably positioned proximate to each seam line 30*a*, 30*b* depending on the particular seam line, size of the user, and the natural arm position of a user. A user of the training system 10 may position either or both of the front and rear blocks 14, 16, 18 slightly anteriorly or posteriorly of the seam lines 30*a*, 30*b*, or any position in between, depending upon their particular preferences. The determining factors, particularly for the blocks 14, 16, 18 around the rear seam line 30*b*, are the size of and natural position of the user's arms relative thereto.

While the following detailed description focuses primarily on use of the inventive sports swing training apparatus in connection with a golf swing, a person skilled in the art will appreciate how the invention also has applicability to training swing arc for other sports. The following detailed description is not intended to limit the scope of this patent to only golf swings.

Figure 3:
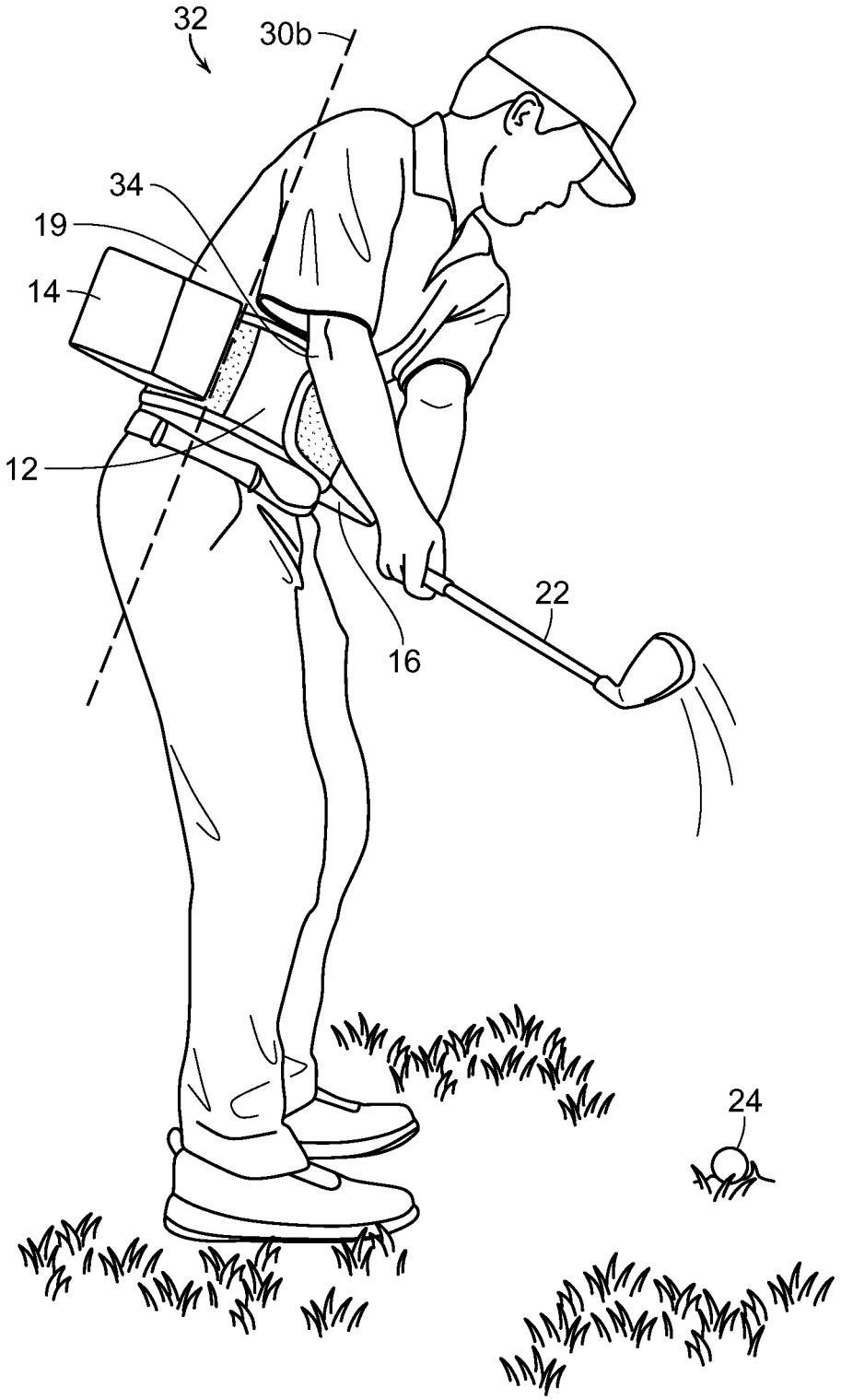
FIG. 3 is a perspective view of the user in FIG. 2 in a partial backswing position.

As shown in FIGS. 3-8, with particular attention to a golf swing, the waist wrap and waist boxes rotate with the golfer's body during the back swing on a full golf swing. FIGS. 3-3B generally illustrate a user of the inventive system in a starting backswing position 32 bringing the club 22 away from the ball 24. This starting backswing position 32 is approximately the bottom ⅓ to ½ of the backswing arc, i.e., up to the club 22 being horizontal to the ground. In this starting backswing position 32, the preference for use of the system 10 is that the user's rear elbow 34 does not make contact with the block 14, 16, 18 attached proximate the rear seam line 30*b*.

Figure 3A:
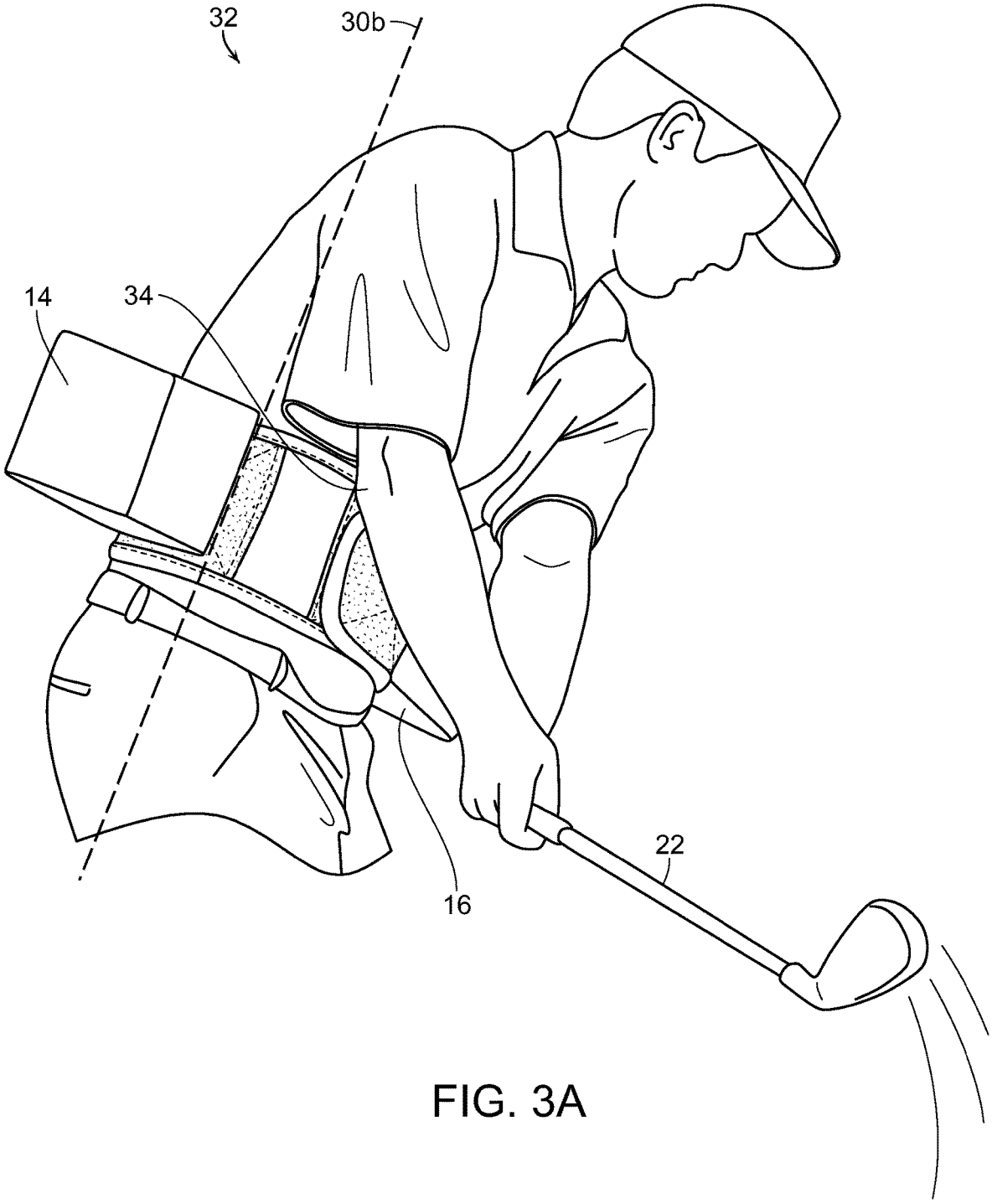
FIG. 3A is a close-up view of the rear elbow of the user in FIG. 3 not making contact with the rear lateral block in the partial backswing position.
Figure 3B:
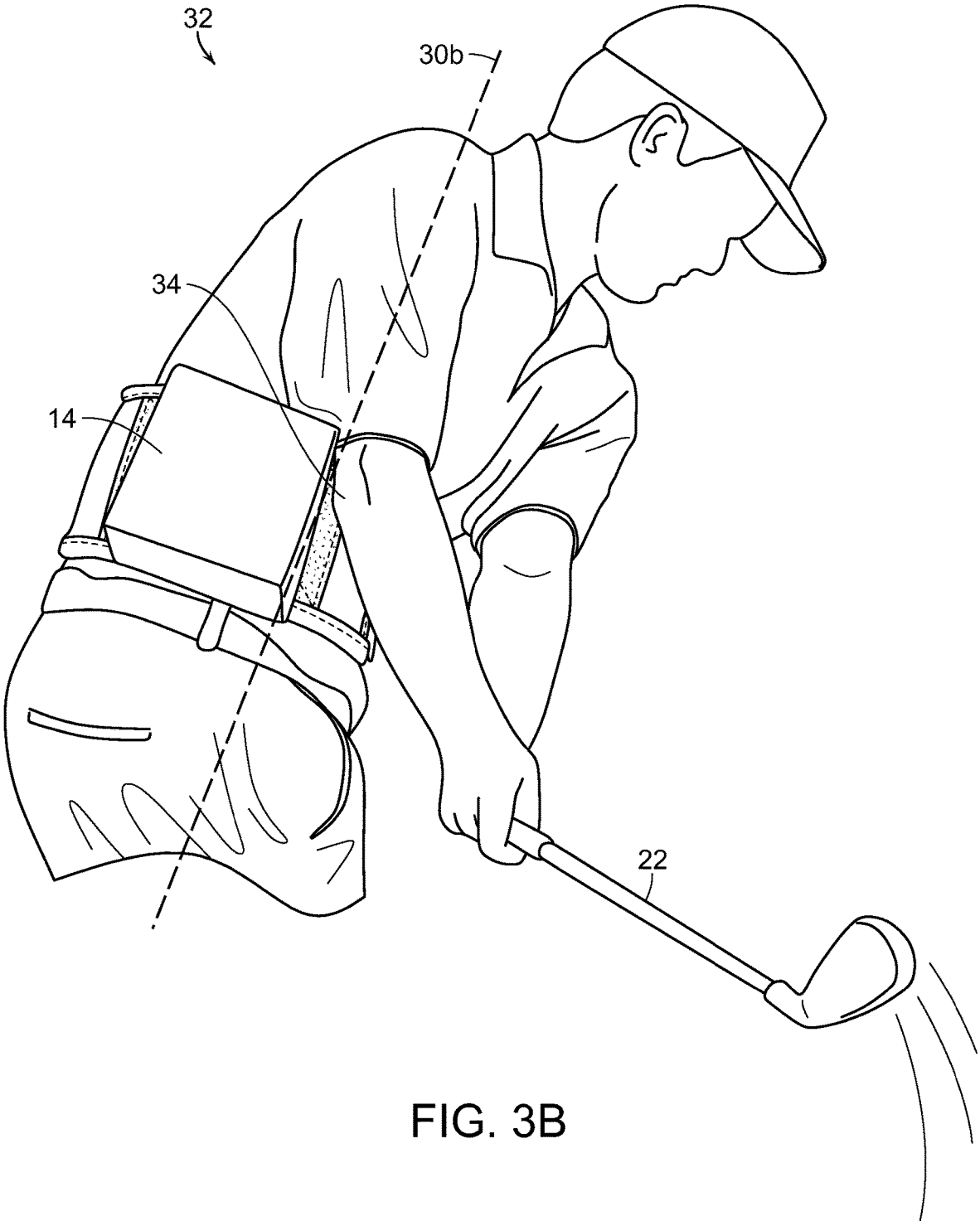
FIG. 3B is a close-up view of the rear elbow of the user in FIG. 3 making contact with the rear lateral block in the partial backswing position.

As shown in FIG. 3A, when the user has appropriate arm swing and body rotation, the rear elbow 34 avoids contact with the block 14, 16, 18. Conversely, in FIG. 3B, when the user has inappropriate arm swing or insufficient body rotation, the rear elbow 34 will contact the block 14, 16, 18. The absence of such contact tells the user that the arm position and body rotation were both proper for the type of swing. The existence of such contact tells the user that either the arm position, body rotation or both were improper for the type of swing. Through repetition, a user can determine which combination of arm position and body rotation needs to be adjusted, thereby improving the swing arc.

Figure 4:
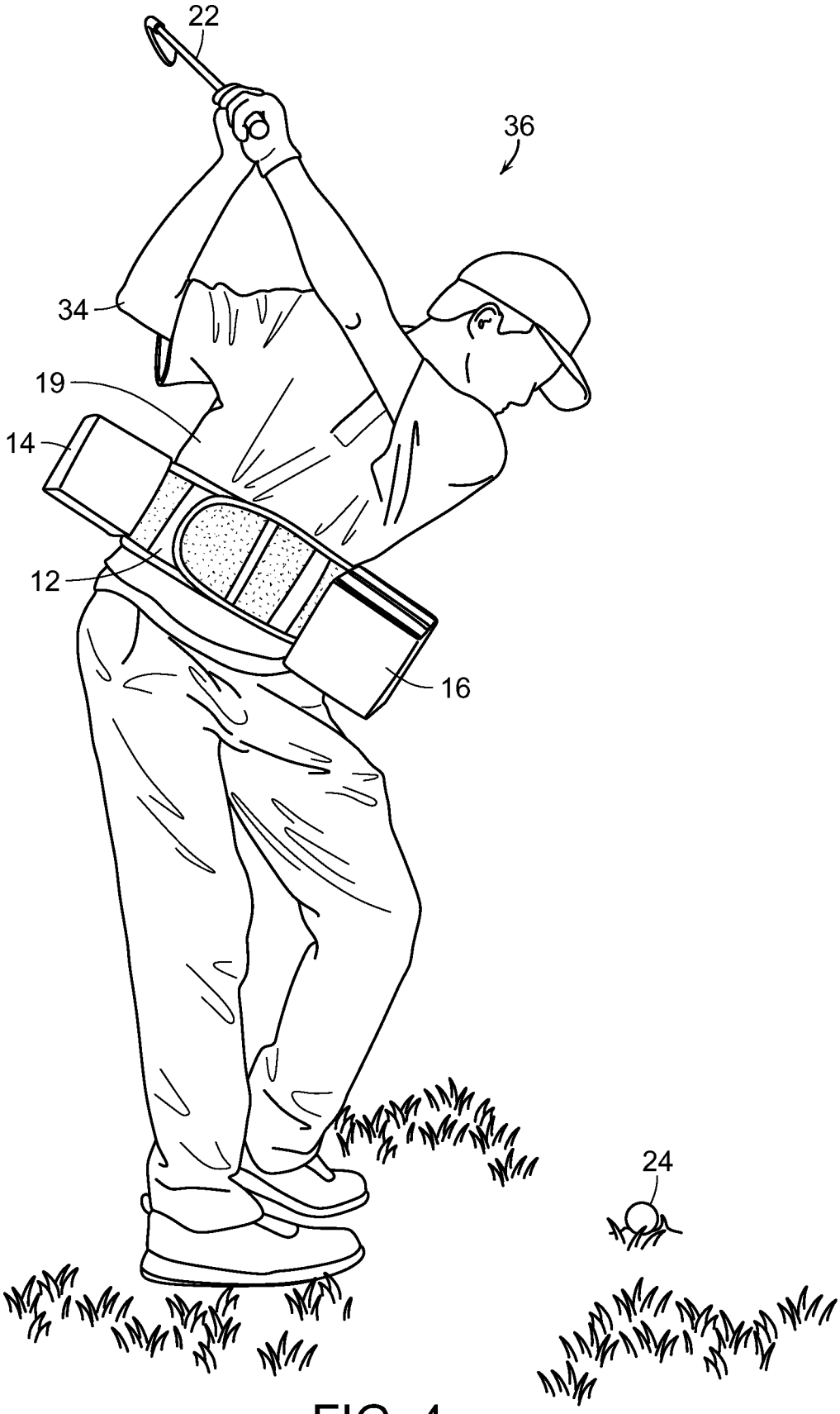
FIG. 4 is a perspective view of the user in FIG. 2 in a full backswing position.
Figure 5:
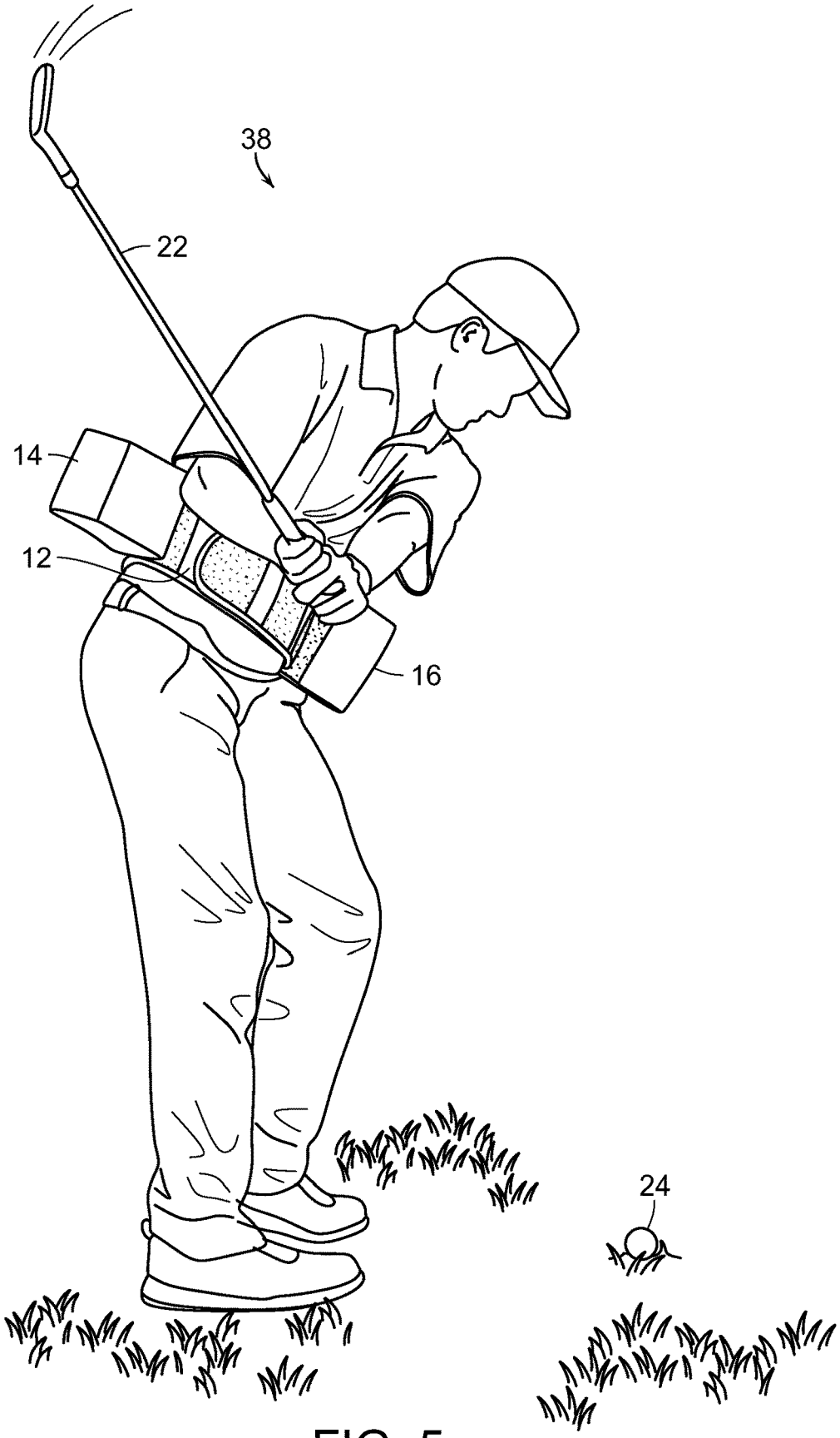
FIG. 5 is a perspective view of the user in FIG. 2 in a partial downswing position.
Figure 5A:
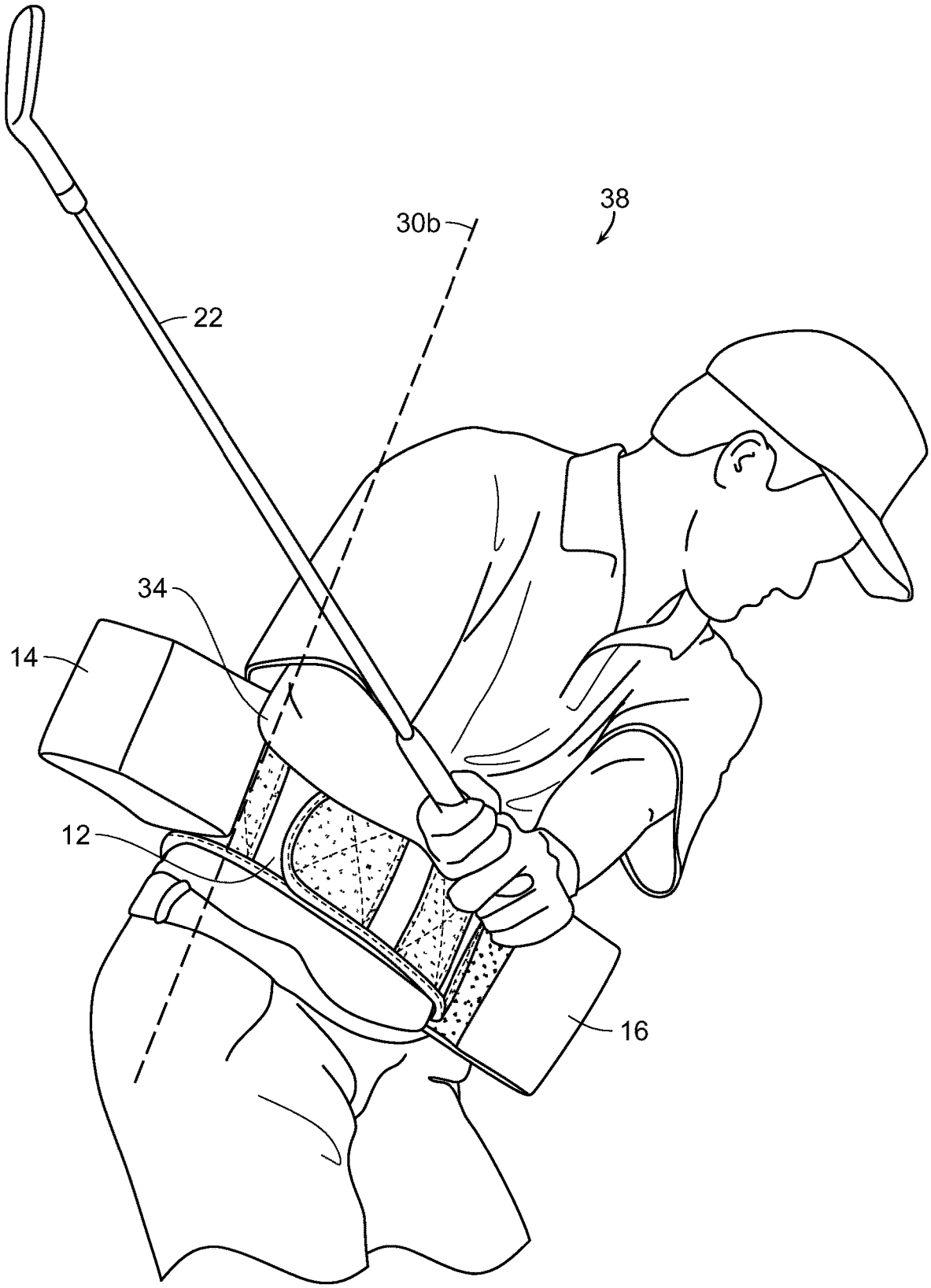
FIG. 5A is a close-up view of the rear elbow of the user in FIG. 5 not making contact with the rear lateral box in the partial downswing position.
Figure 5B:
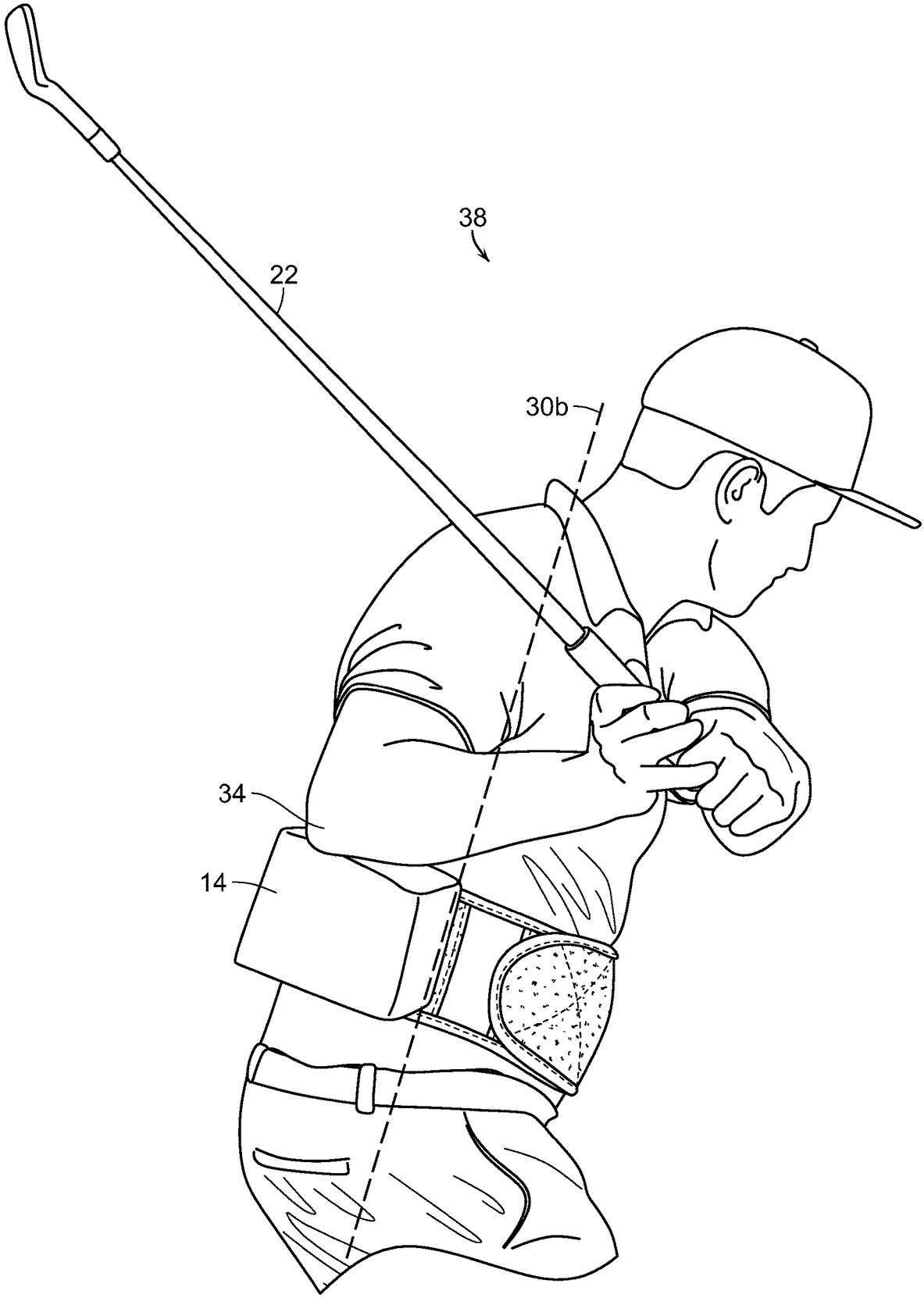
FIG. 5B is a close-up view of the rear elbow of the user in FIG. 5 making contact with the rear lateral box in the partial downswing position.

FIG. 4 generally illustrates the user in a full backswing position 36 with the club 22 at the top of the swing, the waist/torso 19 fully rotated, and the arms up with the rear elbow 34 clear of the block 14, 16, 18 in the rear lateral position 28. FIGS. 5A and 5B illustrate the start of the downswing position 38 from the full backswing position 36. As shown in FIG. 5A, when the user has appropriate arm swing and body rotation, the rear elbow 34 avoids contact with the block 14, 16, 18. Conversely, in FIG. 5B, when the user has inappropriate arm swing or insufficient body rotation, the rear elbow 34 will contact the block 14, 16, 18 on either an anterior surface or a top surface.

As in the starting backswing position 32 the absence of such contact tells the user that the arm position and body rotation were both proper for the type of swing. The existence of such contact tells the user that either the arm position, body rotation or both were improper for the type of swing. Through repetition, a user can determine which combination of arm position and body rotation needs to be adjusted, thereby improving the swing arc.

FIGS. 5A and 5B illustrate the start of the transition or downswing position 38 from the full backswing position 36. As shown in FIG. 5A, when the user has appropriate arm swing and body rotation, the rear elbow 34 avoids contact with the block 14, 16, 18 indicating the positioning of the club in a desired anterior swing plane. Conversely, in FIG. 5B, when the user has inappropriate arm swing or insufficient body rotation, the rear elbow 34 will contact the block 14, 16, 18 on either an anterior surface or a top surface, indicating the positioning of the club in an undesired posterior swing plane.

As in the starting backswing position 32 the absence of such contact tells the user that the arm position and body rotation were both proper for the type of swing. The existence of such contact tells the user that either the arm position, body rotation or both were improper for the type of swing. Through repetition, a user can determine which combination of arm position and body rotation needs to be adjusted, thereby improving the swing arc.

Figure 6:
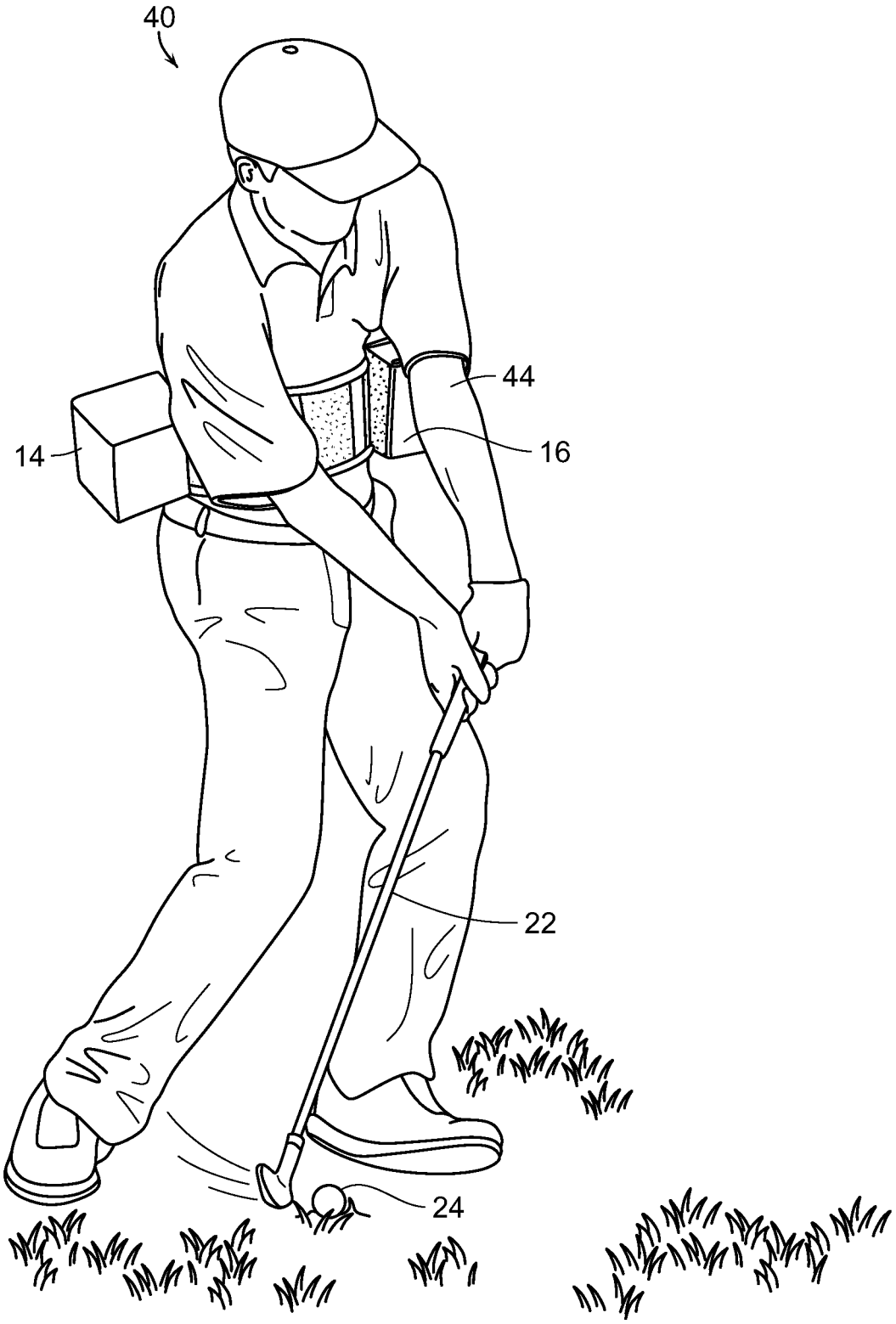
FIG. 6 is a perspective view of the user in FIG. 2 in a ball impact position.

FIG. 6 generally illustrates the user in an impact position 40 with the club 22 against the ball 24, the waist/torso 19 rotated toward the front, the arms starting the transition across the body at the bottom of a swing arc with the rear elbow 34 having fully cleared the block 14, 16, 18 in the rear lateral position 28.

Figure 7:
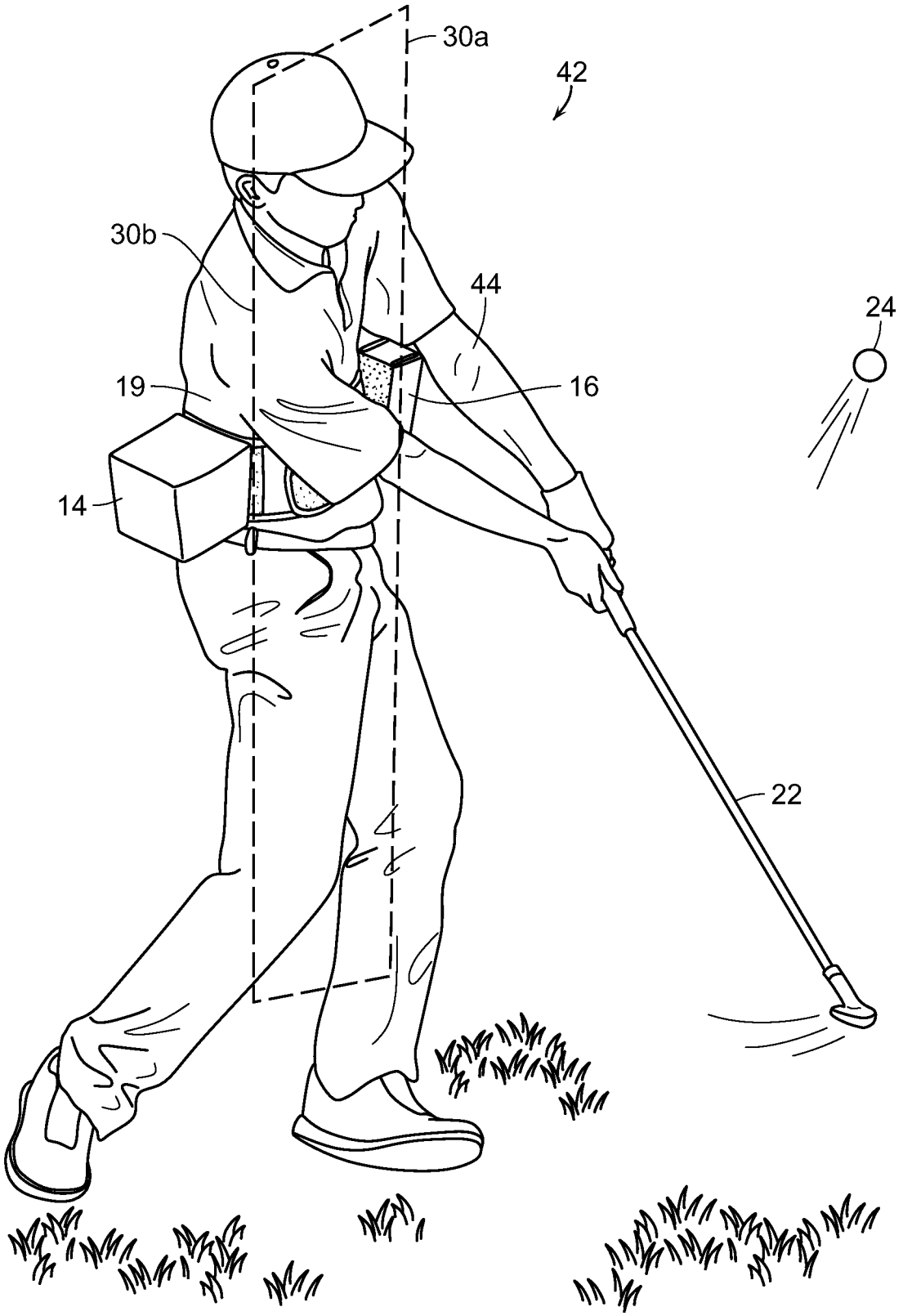
FIG. 7 is a perspective view of the user in FIG. 2 in a partial follow through position.
Figure 7A:
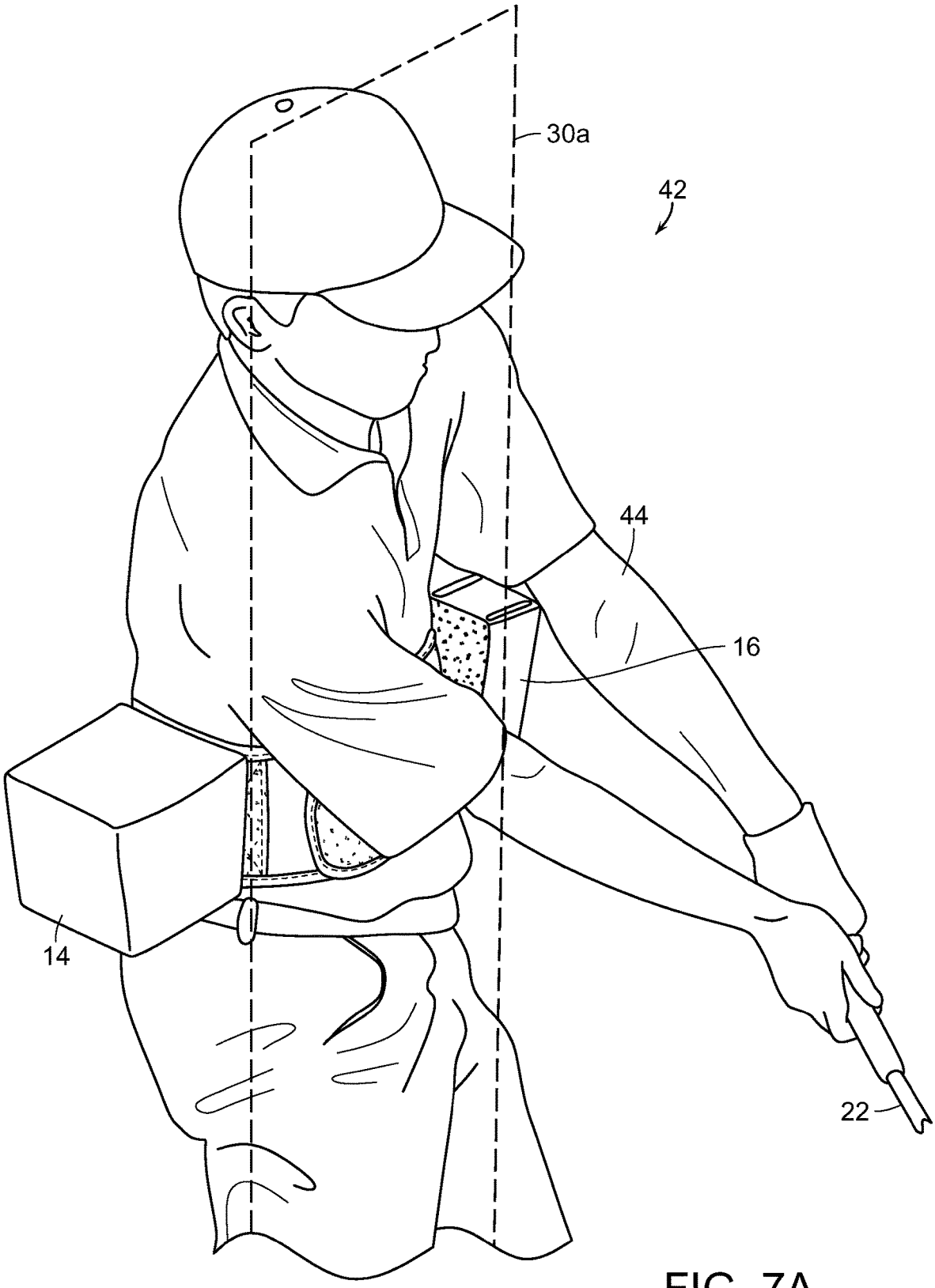
FIG. 7A is a close-up view of the front elbow of the user in FIG. 7 not making contact with the front lateral box in the partial follow through position.
Figure 7B:
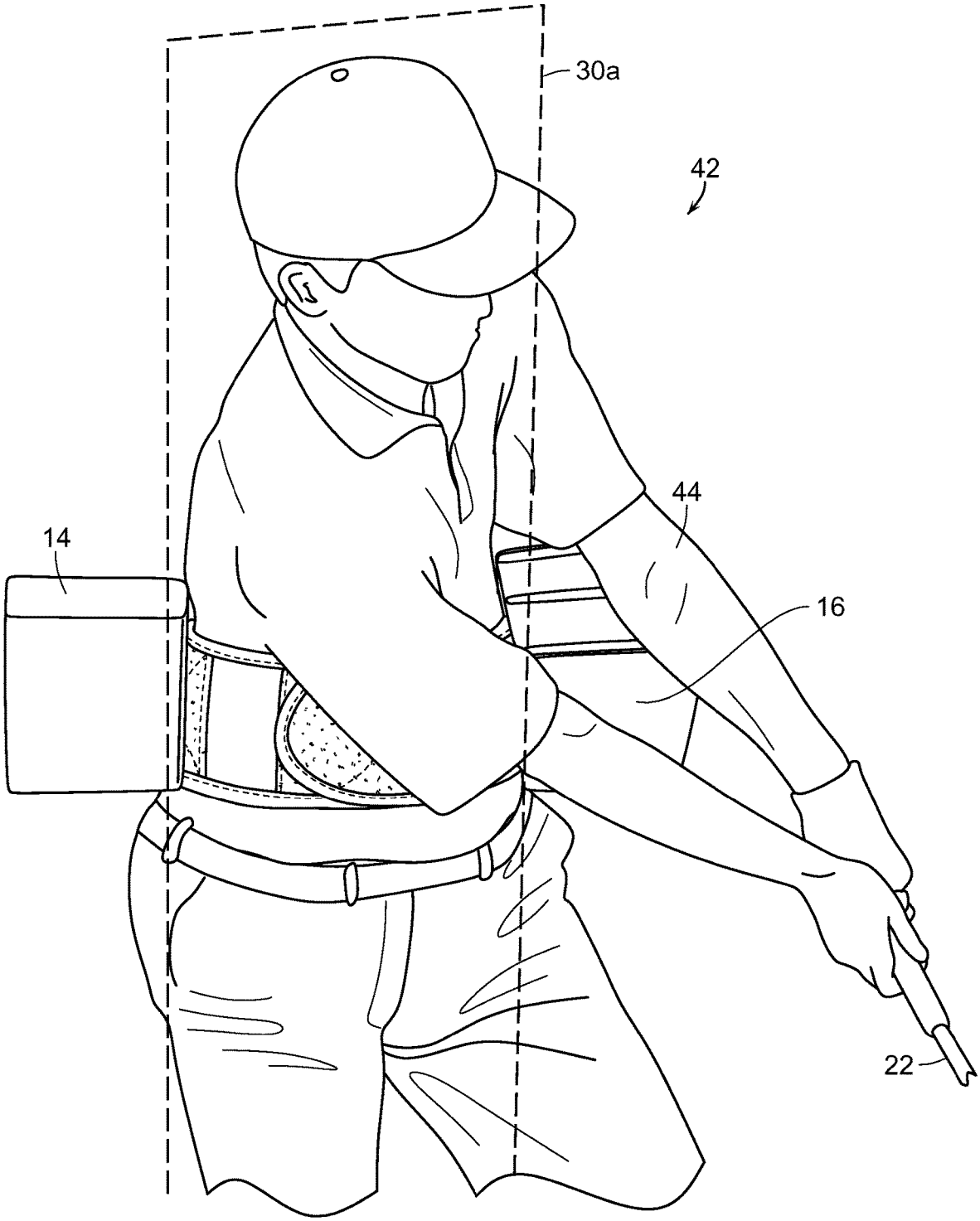
FIG. 7B is a close-up view of the front elbow of the user in FIG. 7 making contact with the front lateral box in the partial follow through position.

FIGS. 7-7B generally illustrate a user of the inventive system in a starting frontswing or follow through position 42 bringing the club 22 forward after striking the ball 24. This starting follow through position 42 is approximately the bottom ⅓ to ½ of the follow through arc with the club 22 moving toward horizontal to the ground. In this starting follow through position 42, the preference for use of the system 10 is that the user's front elbow 44 does not make contact with the block 14, 16, 18 attached proximate the front lateral position 30*a*.

Figure 8:
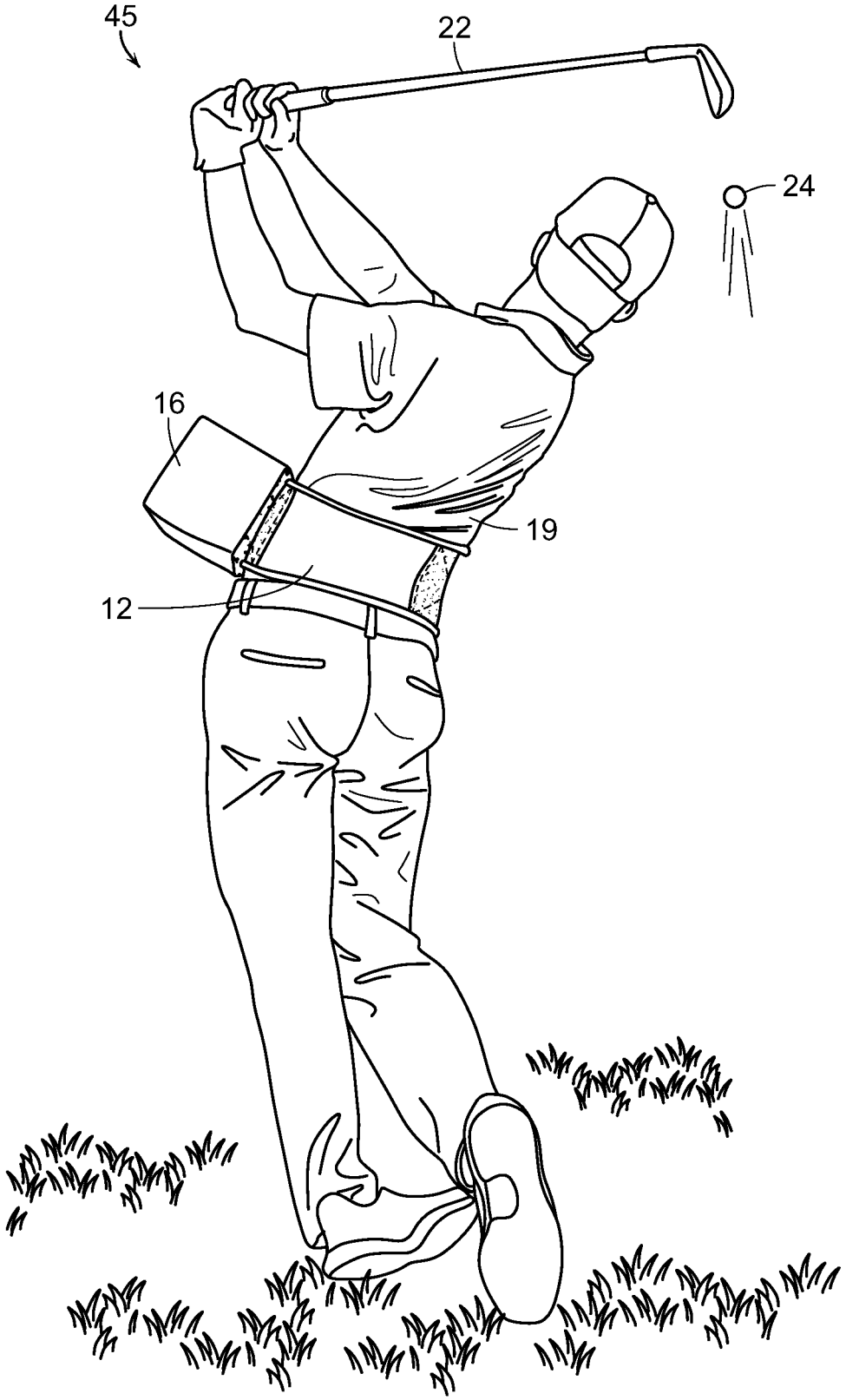
FIG. 8 is a perspective view of the user in FIG. 2 in a full follow through position.

As shown in FIG. 7A, when the user has appropriate arm swing and body rotation, the front elbow 44 avoids contact with the block 14, 16, 18. Conversely, in FIG. 7B, when the user has inappropriate arm swing or insufficient body rotation, the front elbow 44 will contact the block 14, 16, 18. The absence of such contact tells the user that the arm position and body rotation were both proper for the type of swing. The existence of such contact tells the user that either the arm position, body rotation or both were improper for the type of swing. Through repetition, a user can determine which combination of arm position and body rotation needs to be adjusted, thereby improving the swing arc. FIG. 8 generally illustrates the user at the top of the frontswing or follow through position 45 with the waist/torso 19 fully rotated and the arms up.

Figure 9A:
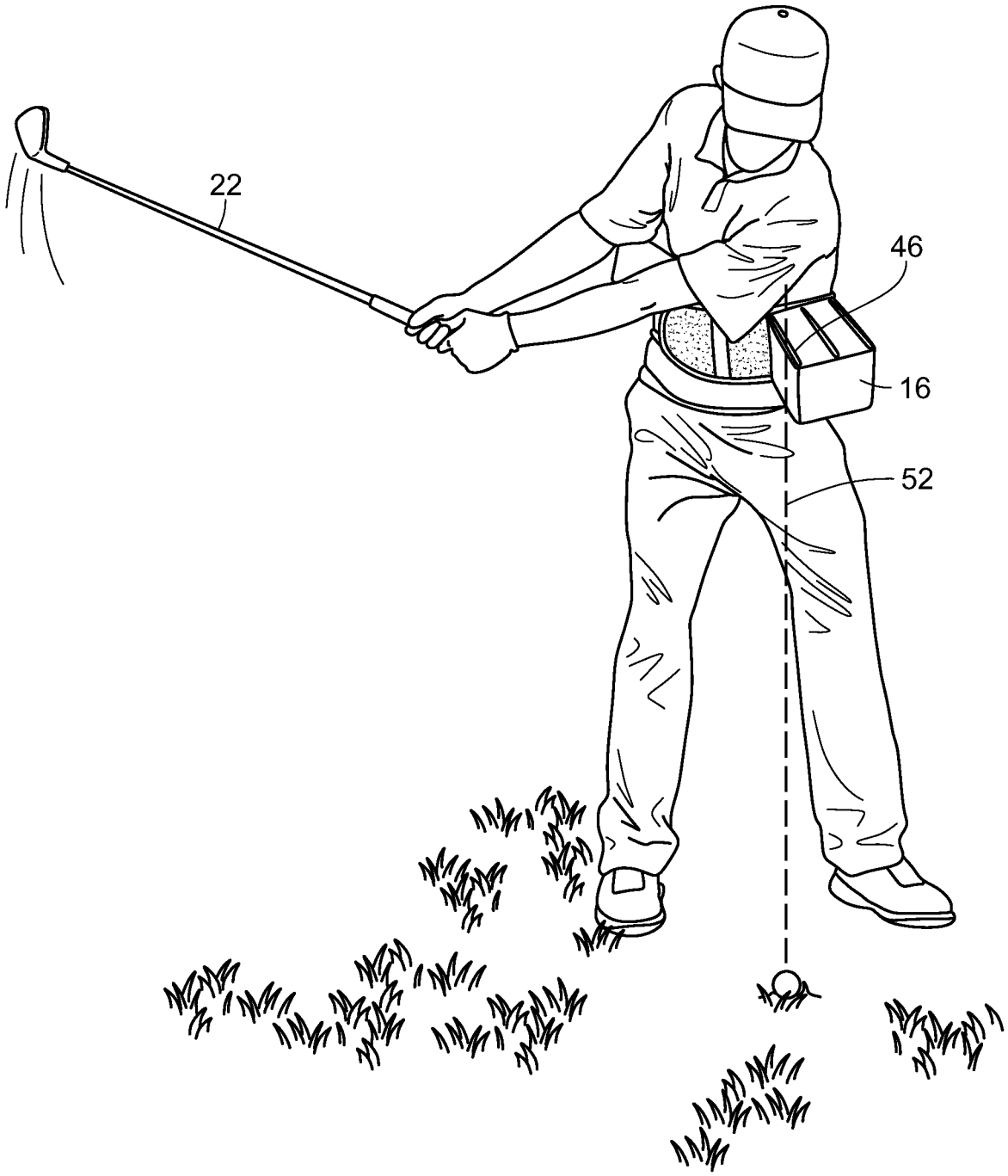
FIG. 9A is a perspective view of the user in FIG. 2 in a start of backswing position wearing the inventive sports swing training apparatus having a front lateral swing box with rotation markings.
Figure 9B:
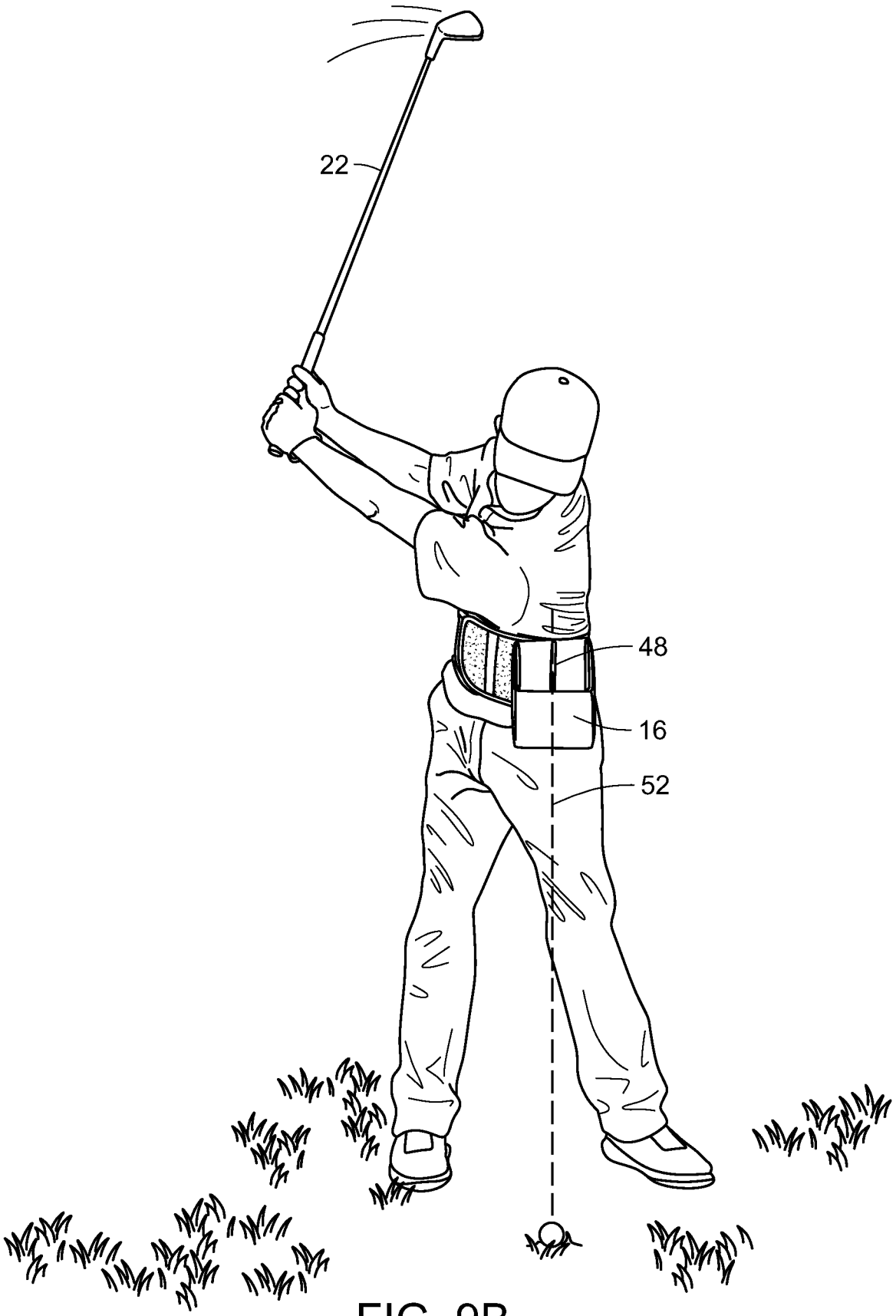
FIG. 9B is a perspective view of the user in FIG. 2 in a mid-backswing position wearing the inventive sports swing training apparatus having a front lateral swing box with rotation markings.
Figure 9C:
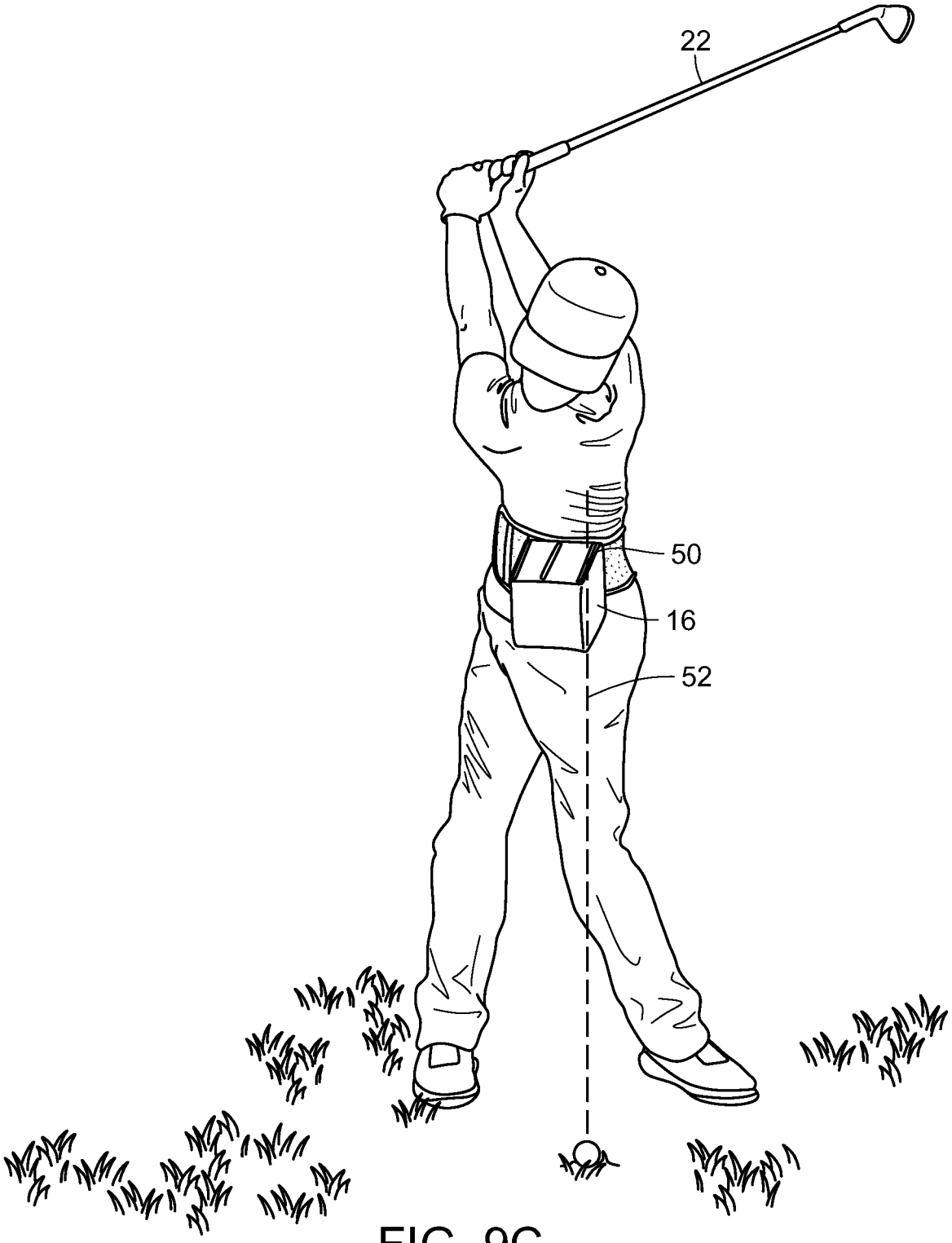
FIG. 9C is a perspective view of the user in FIG. 2 in a full backswing position wearing the inventive sports swing training apparatus having a front lateral swing box with rotation markings.
Figure 10:
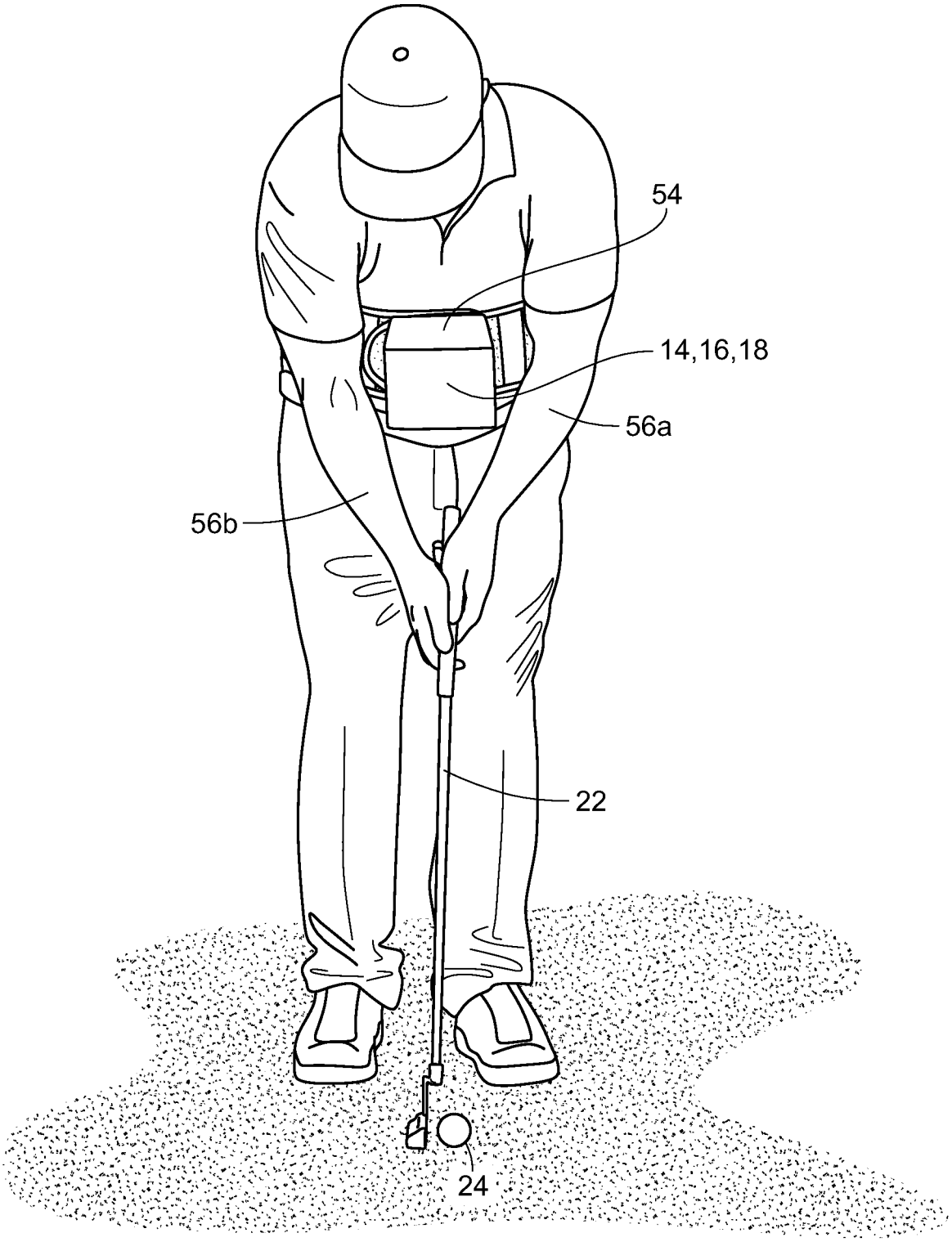
FIG. 10 is a perspective view of the inventive sports swing training apparatus with a user wearing the waist belt having an abdominal swing box in an address position for a putting or chipping swing.

FIGS. 9A-9C generally illustrate the user at various position throughout the backswing movement illustrating the use of the guidelines 16*c* on the upper surface 16*b* of the block 16 in the front lateral position 26. The guidelines 16*c* generally have a first guideline 46, second guideline 48, and third guideline 50. The first guideline 46 is generally aligned with the leading face. The second guideline 48 is generally aligned with a center or mid-line on the upper face. The third guideline 50 is generally aligned with a trailing face.

These guidelines 46, 48, 50 help the user measure the degree of rotation of the waist/torso 19 through the backswing. In FIG. 9A, the first guideline 46 is configured for the user to align the end with a vertical line 52 extending upward from the ball 24 at the start of the body rotation in the backswing. In FIG. 9B, the second guideline 48 is configured for the user to align the end with the same vertical line 52 extending from the ball 24 with a greater degree of body rotation. In FIG. 9C, the third guideline 50 is configured for the user to align the end with the same vertical line 52 extending from the ball 24 with full body rotation. This alignment helps the user to visualize the amount of body rotation that is expected in a golf swing.

FIGS. 10-12B generally illustrate the use of the inventive system 10 in the user's address of a putting shot. In this type of shot, the system 10 does not utilize the front or rear lateral positions 26, 28. Instead, the system 10 utilizes an attachment area 12*c* in an abdominal position 54, placing the block 14, 16, 18 anteriorly relative to the user. The block 14, 16, 18 may be attached to the abdominal position 54 in either in a high position or a low position, subject to the preference of the user. In the starting address position (FIG. 10), there is no contact between the user's arms 56 and the block 14, 16, 18. Alternatively, a user's arms 56 may be drawn in so as to minimally contact the sides of the block 14, 16, 18 during address. There should not be excessive contact with the block 14, 16, 18 during address.

Figure 11:
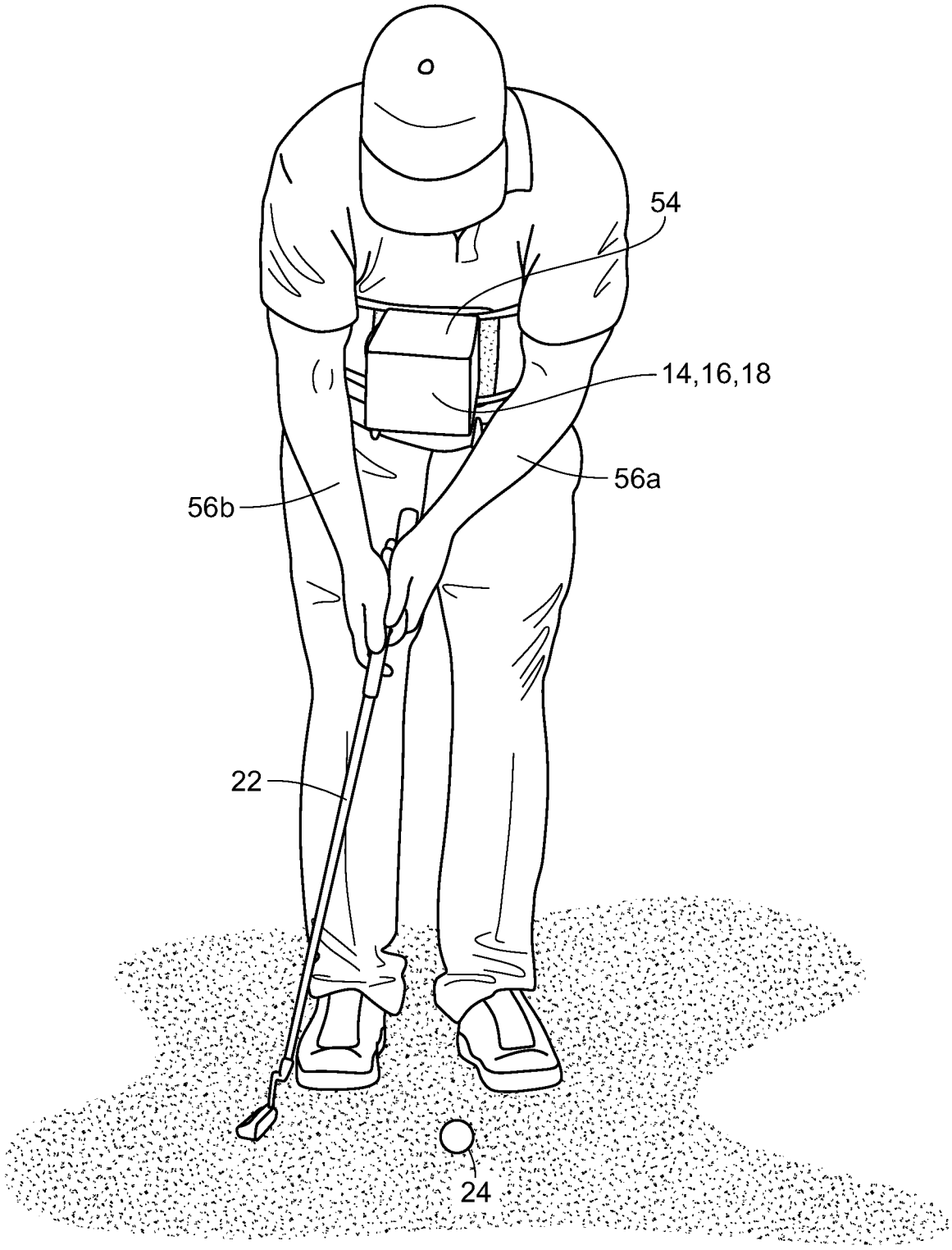
FIG. 11 is a perspective view of the user in FIG. 10 in a putting backswing position with no contact between the arms and the abdominal box.
Figure 11A:
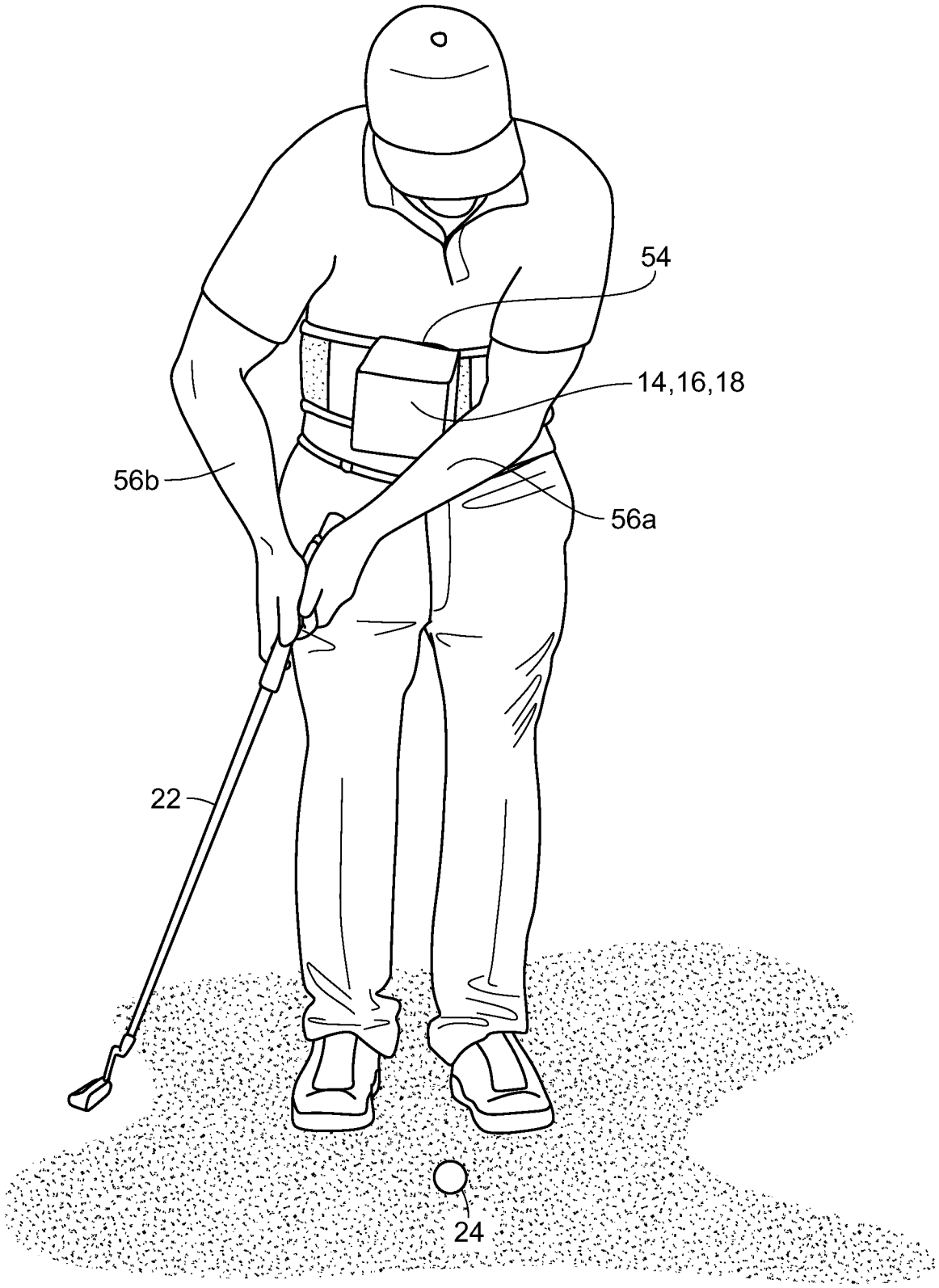
FIG. 11A is a perspective view of the user in FIG. 11 showing the front arm making contact with the abdominal box.
Figure 11B:
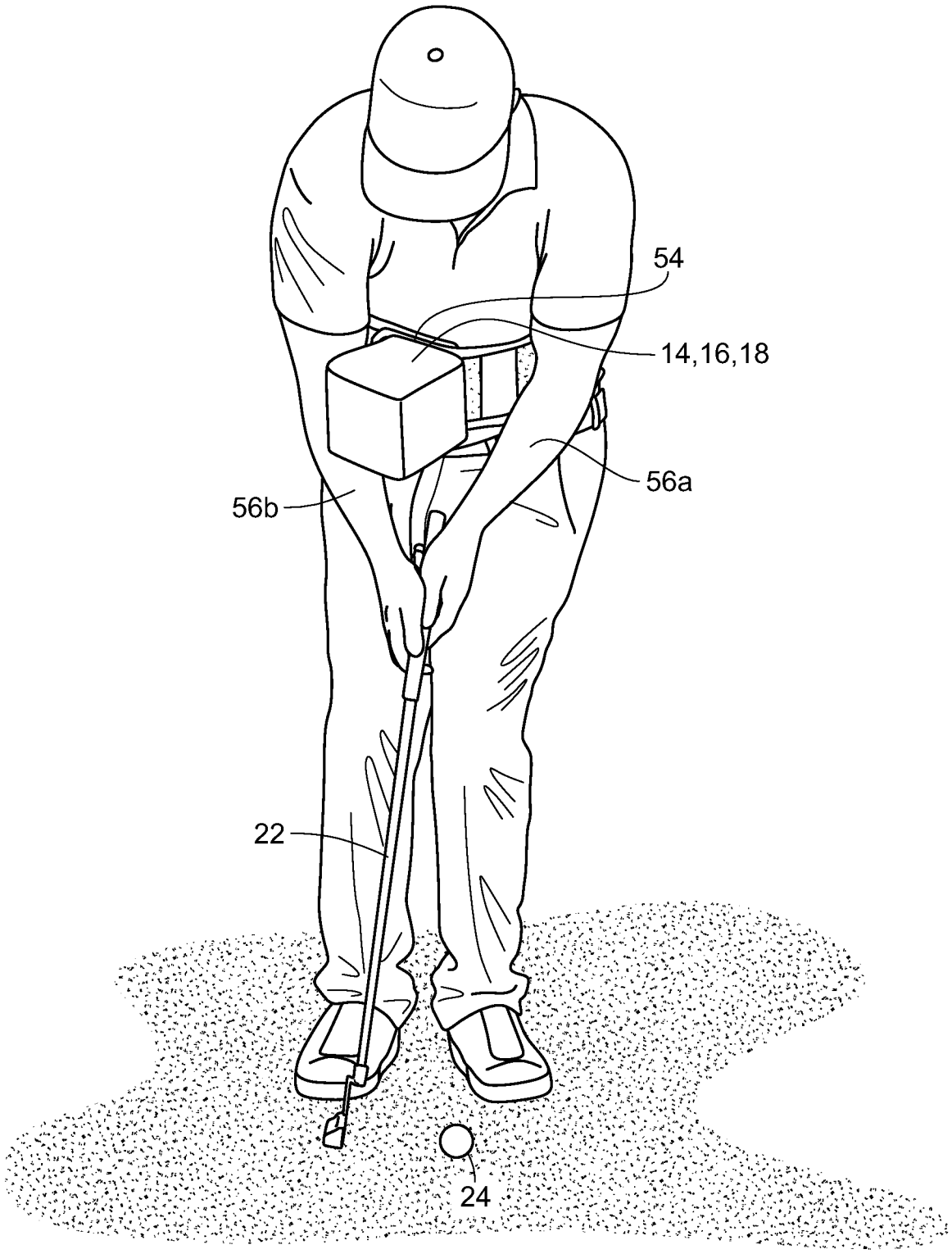
FIG. 11B is a perspective view of the user in FIG. 11 showing the rear arm making contact with the abdominal box.

FIG. 11 illustrates an intended backswing movement with uniform body rotation and arm swing so that there is no contact between the arms 56 and the block 14, 16, 18. FIG. 11A illustrates an unintended movement where there is too much arm swing and/or not enough body rotation such that there is contact between the front arm 56*a* and the block 14, 16, 18. FIG. 11B illustrates a converse situation where there is too much body rotation and/or not enough arm swing such that there is contact between the rear arm 56*b* and the block 14, 16, 18.

Figure 11C:
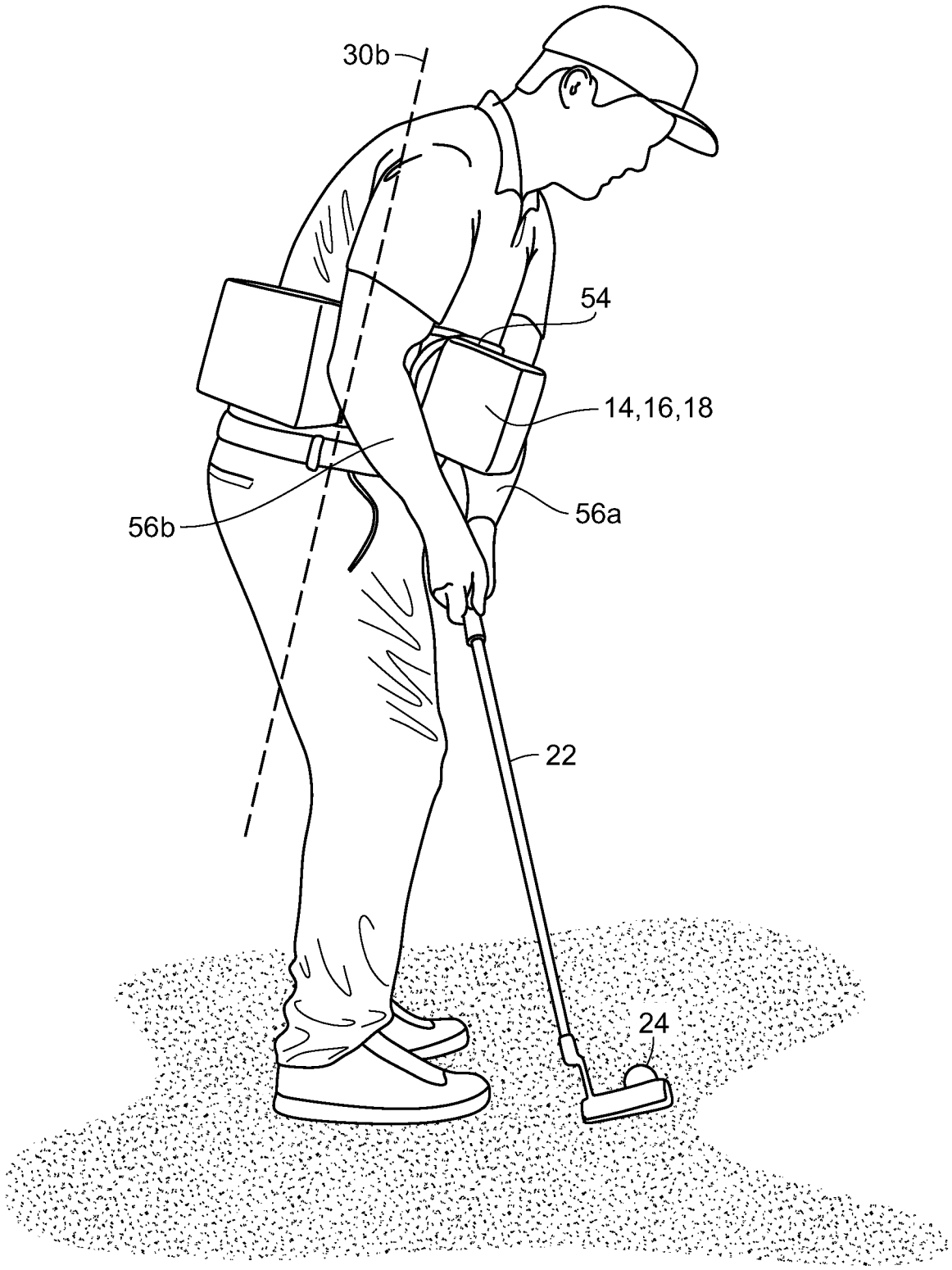
FIG. 11C is a side perspective view of the user in FIG. 11 showing the rear arm making contact with a rear lateral box.

FIG. 11C illustrates an alternate embodiment including a second block 14, 16, 18 attached in a rear lateral position 28 along rear line 30*b*. This places the block 14, 16, 18 behind the rear elbow 34 of the user. In use, a proper swing plane would avoid contact between the rear elbow 34 and this block 14, 16, 18 in the rear lateral position. As shown in FIG. 11C, an improper swing plane causes contact between the rear elbow 34 and this block 14, 16, 18. This alternate embodiment can be used on its own or in combination with the block 14, 16, 18 attached in the abdominal position 54. Although shown with a putting stroke, this positioning of the block 14, 16, 18 can be used to practice and train either putting or chipping strokes by preventing excessive contact by the rear elbow 34 with the block 14, 16, 18 in the rear lateral position 28 during such strokes.

Figure 12:
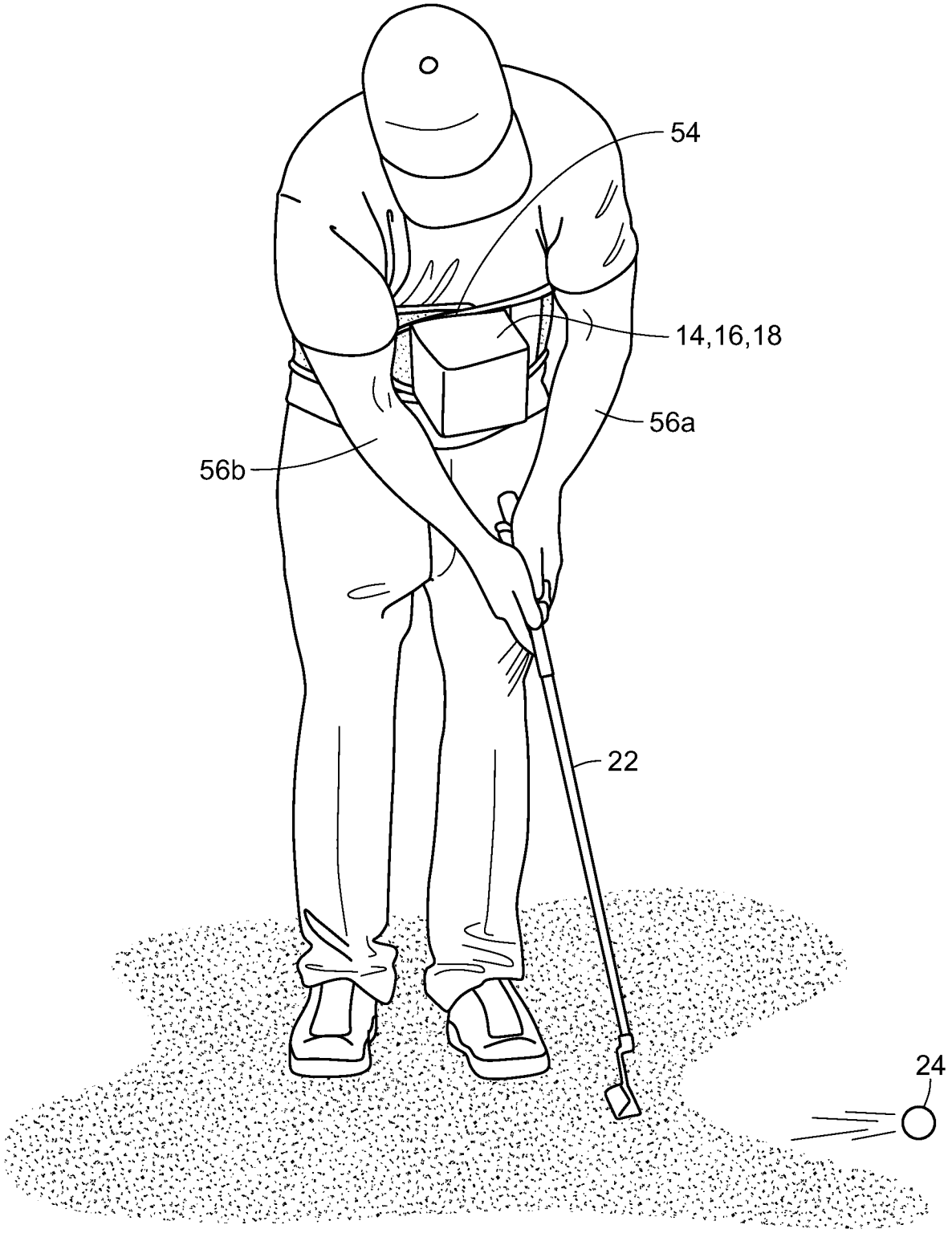
FIG. 12 is a perspective view of the user in FIG. 10 in a putting follow through position with no contact between the arms and the abdominal box.
Figure 12A:
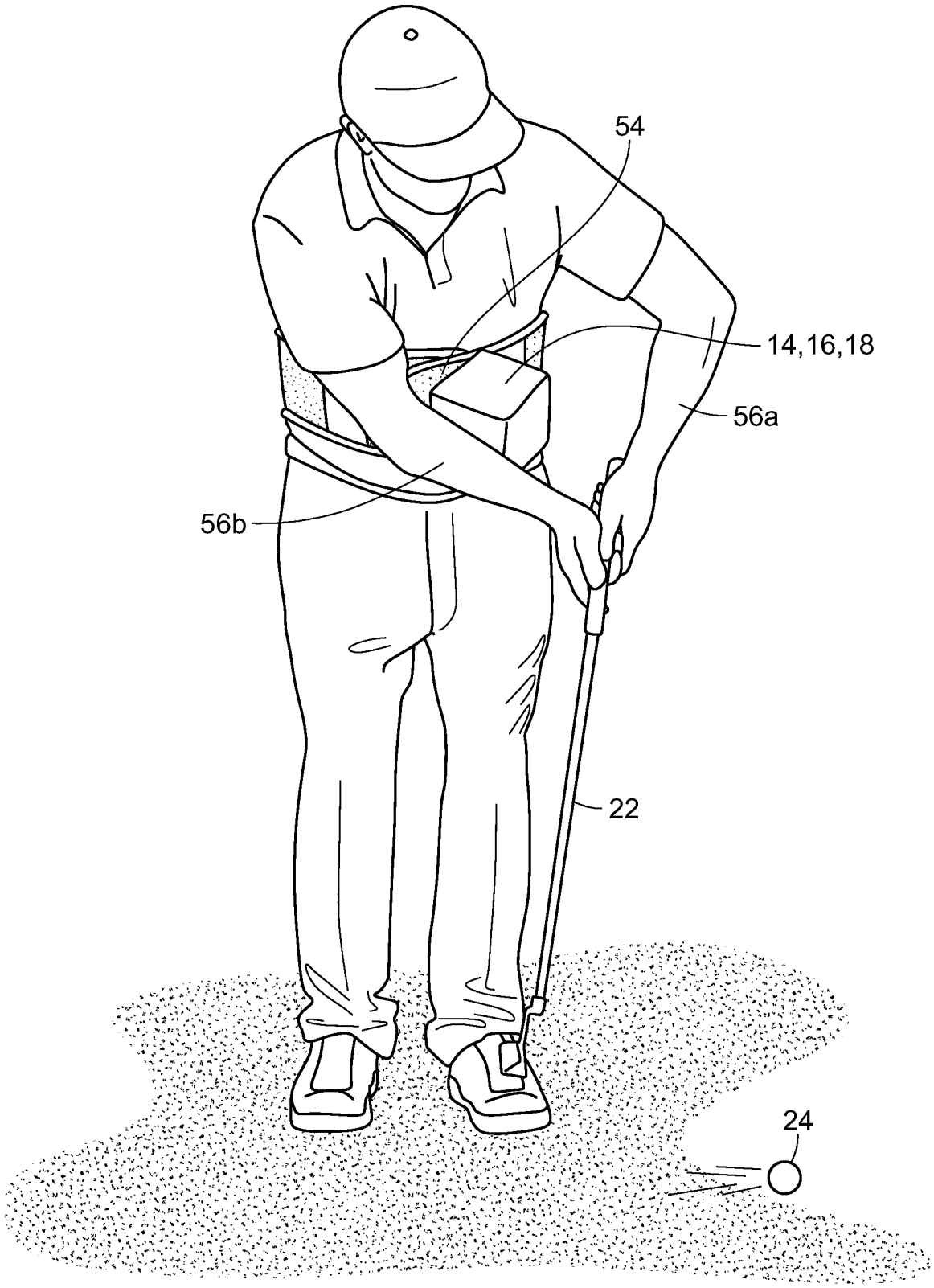
FIG. 12A is a perspective view of the user in FIG. 12 showing the front arm making contact with the abdominal box.
Figure 12B:
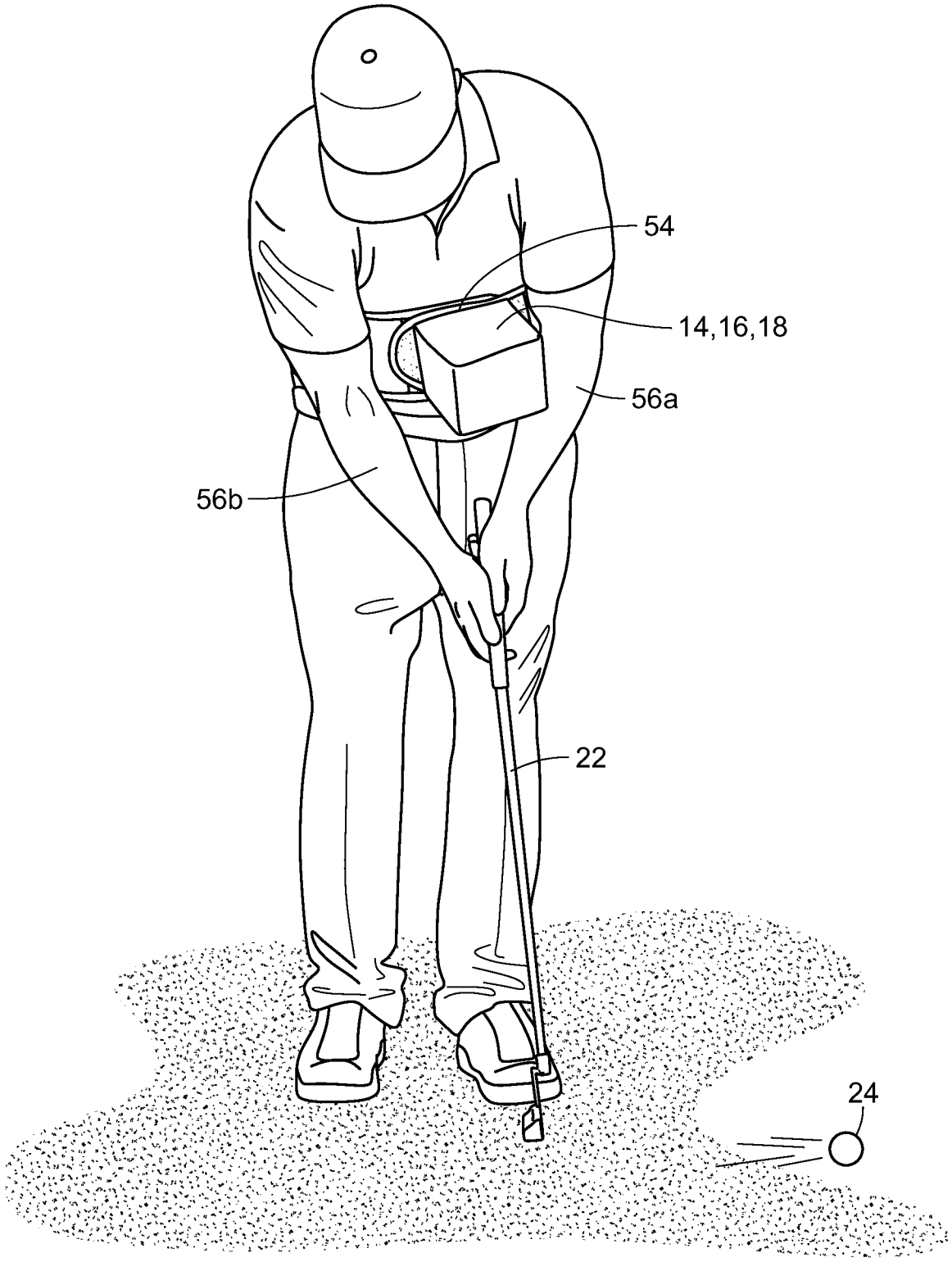
FIG. 12B is a perspective view of the user in FIG. 12 showing the rear arm making contact with the abdominal box.

FIG. 12 illustrates an intended follow through movement with uniform body rotation and arm swing so that there is no contact between the arms 56 and the block 14, 16, 18. FIG. 12A illustrates an unintended movement where there is too much arm swing and/or not enough body rotation such that there is contact between the rear arm 56*b* and the block 14, 16, 18. FIG. 12B illustrates a converse situation where there is too much body rotation and/or not enough arm swing such that there is contact between the front arm 56*a* and the block 14, 16, 18.

Figure 13:
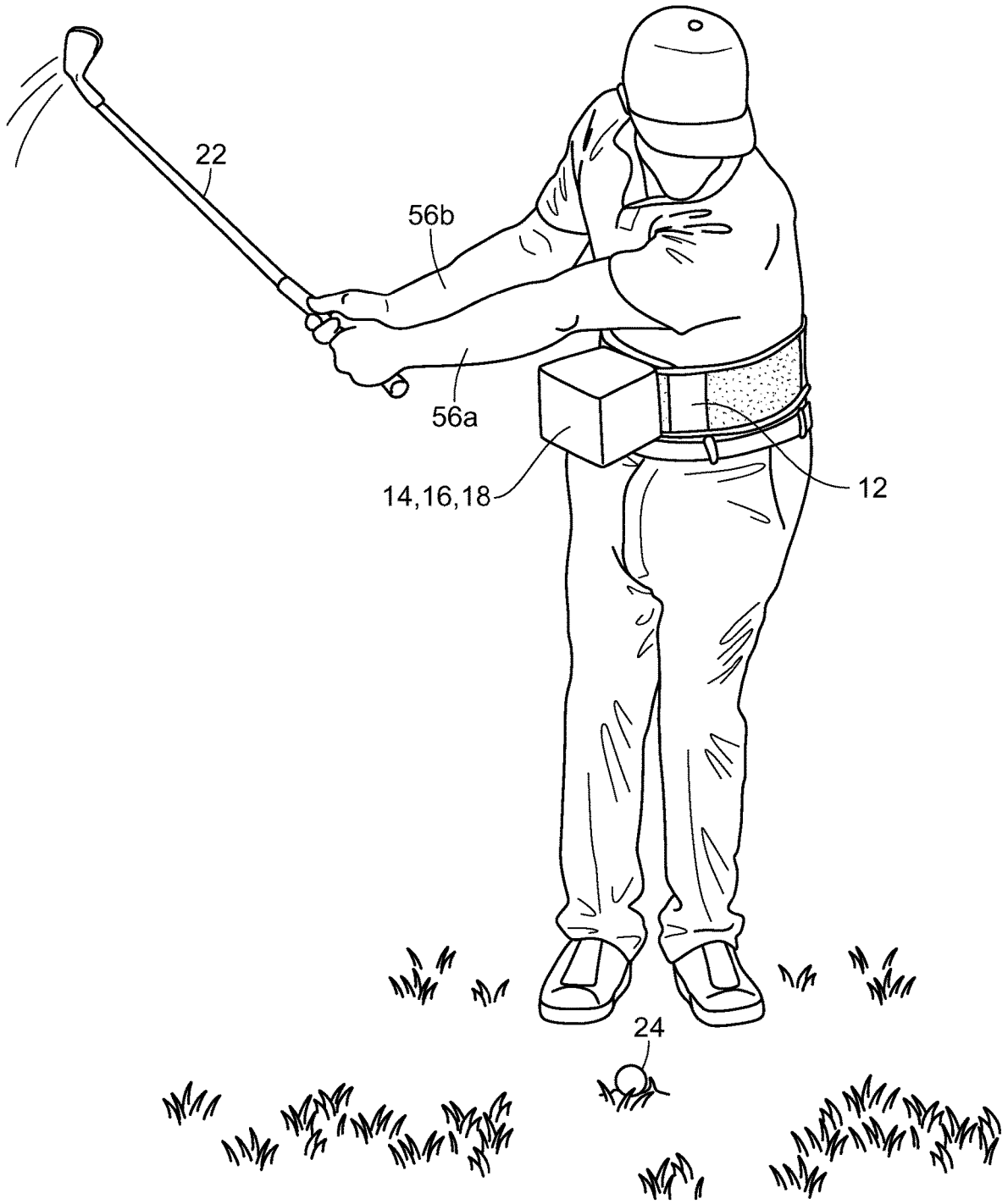
FIG. 13 is a perspective view of the user in FIG. 10 in a chipping backswing position with no contact between the arms and the abdominal box.
Figure 14:
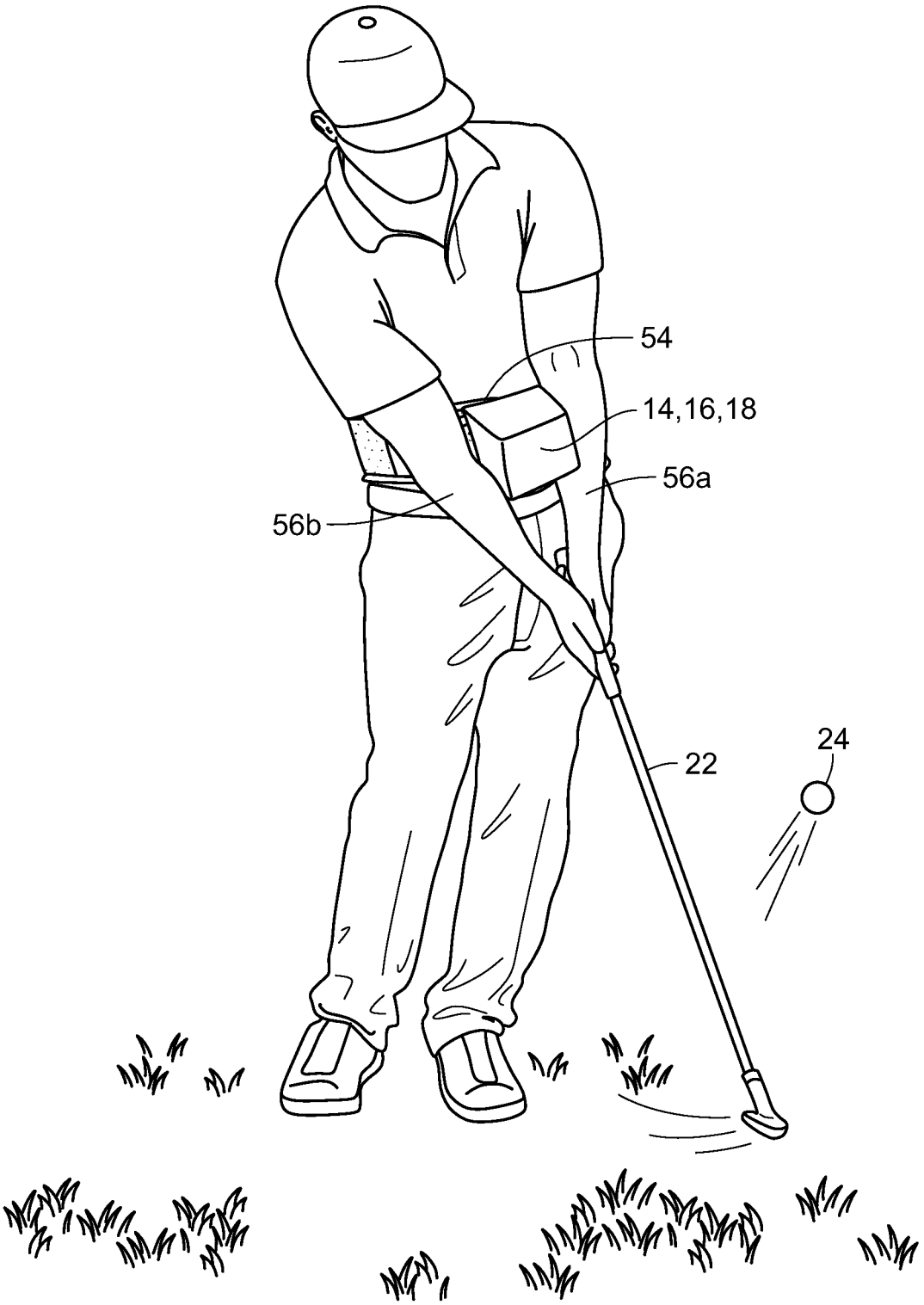
FIG. 14 is a perspective view of the user in FIG. 10 in a chipping follow through position with no contact between the arms and the abdominal box.
Figure 14A:
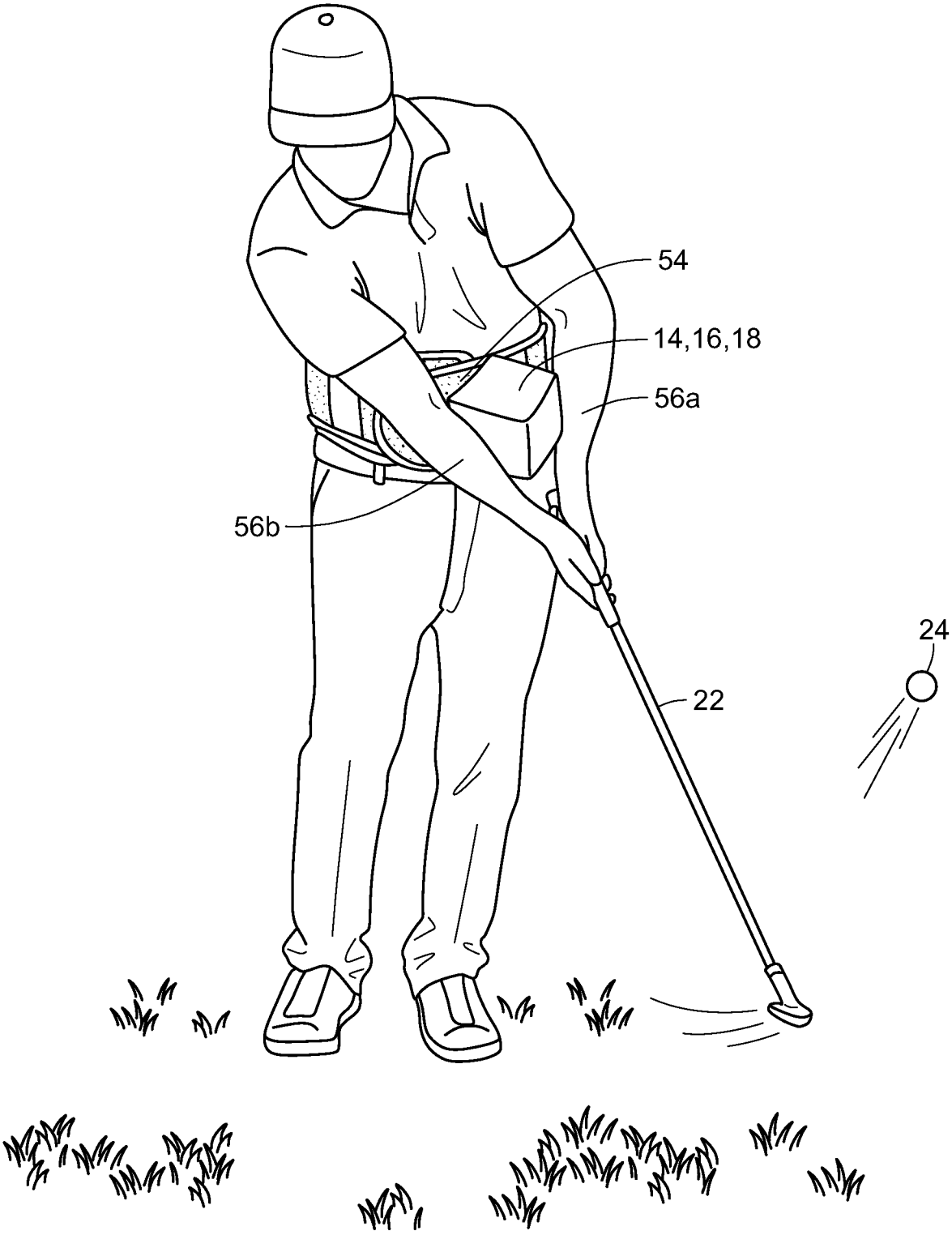
FIG. 14A is a perspective view of the user in FIG. 14 showing the front arm making contact with the abdominal box.
Figure 14B:
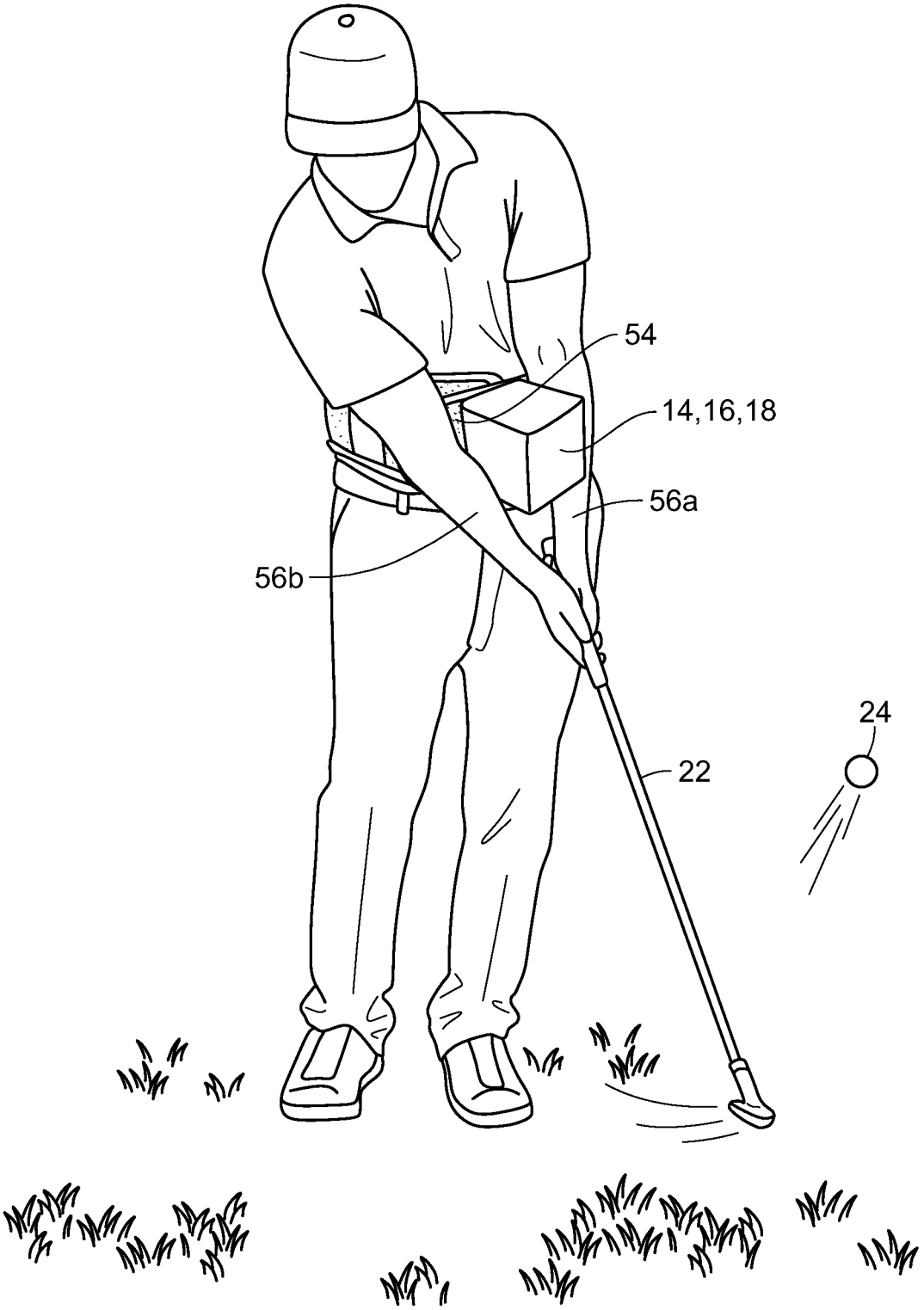
FIG. 14B is a perspective view of the user in FIG. 14 showing the rear arm making contact with the abdominal box.

FIGS. 13-14B generally illustrate the use of the inventive system 10 in the user's address of a chipping shot. In this type of shot, the system 10 again does not utilize the front or rear lateral positions 26, 28. Instead, the system 10 utilizes the attachment area 12*c* in an abdominal position 54, placing the block 14, 16, 18 anteriorly relative to the user. The block 14, 16, 18 may be attached to the abdominal position 54 in either in a high position or a low position, subject to the preference of the user. In the starting address position (same as FIG. 10 but with different club), there is no contact between the user's arms 56 and the block 14, 16, 18. Alternatively, a user's arms 56 may be drawn in so as to minimally contact the sides of the block 14, 16, 18 during address. There should not be excessive contact with the block 14, 16, 18 during address.

Figure 13A:
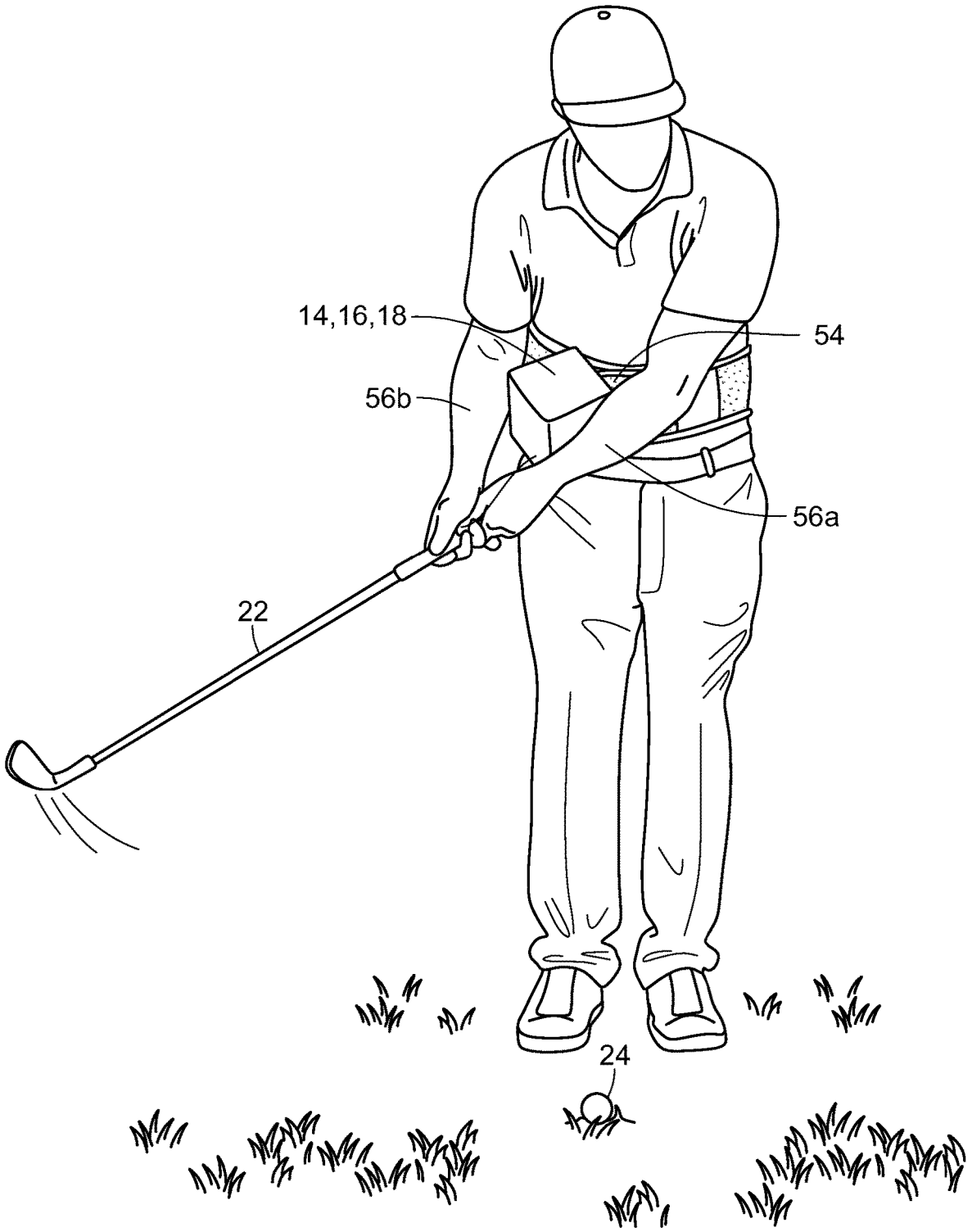
FIG. 13A is a perspective view of the user in FIG. 13 showing the front arm making contact with the abdominal box.
Figure 13B:
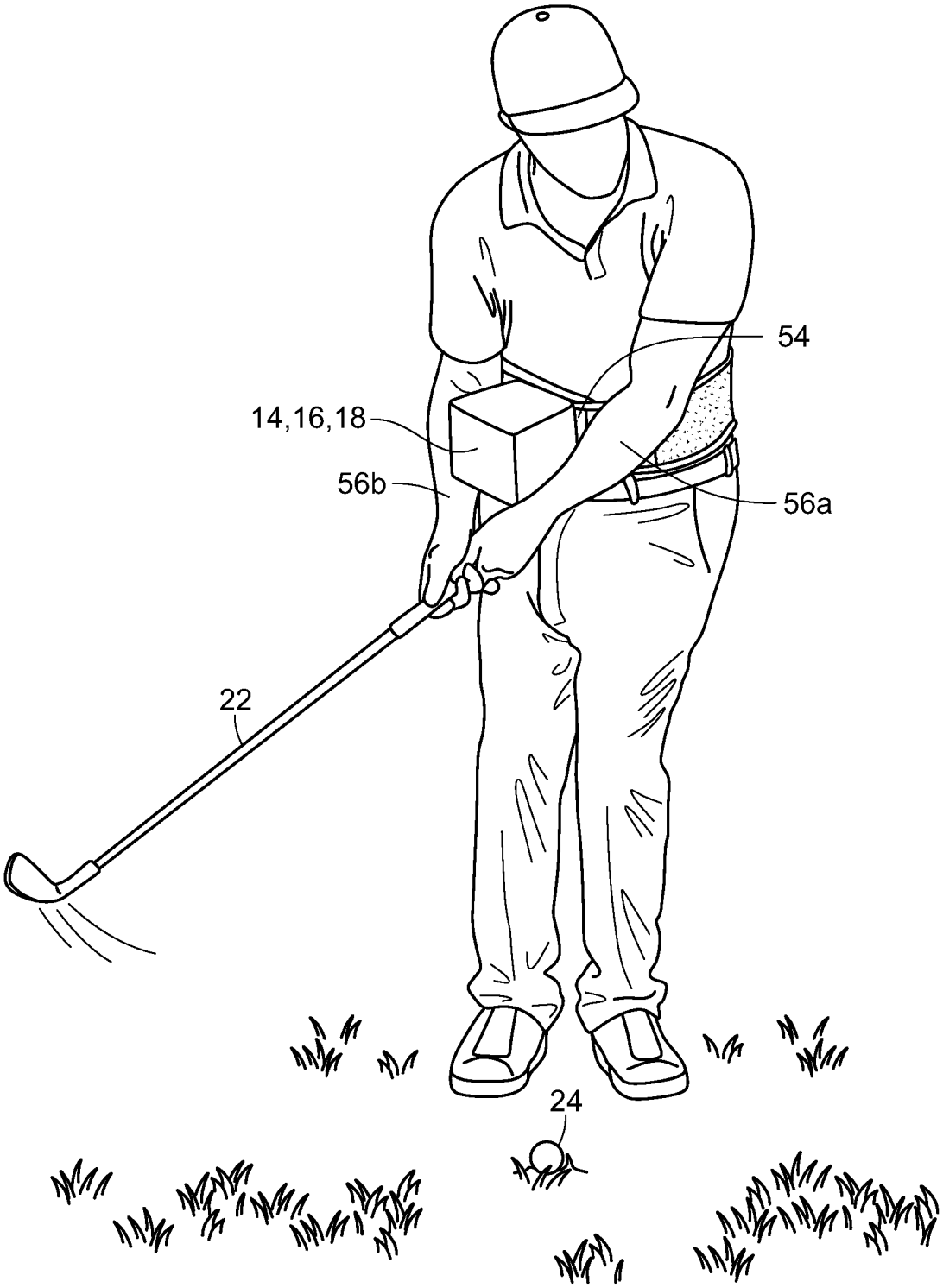
FIG. 13B is a perspective view of the user in FIG. 13 showing the rear arm making contact with the abdominal box.

FIG. 13 illustrates an intended backswing movement with uniform body rotation and arm swing so that there is no contact between the arms 56 and the block 14, 16, 18. FIG. 13A illustrates an unintended movement where there is too much arm swing and/or not enough body rotation such that there is contact between the front arm 56*a* and the block 14, 16, 18. FIG. 13B illustrates a converse situation where there is too much body rotation and/or not enough arm swing such that there is contact between the rear arm 56*b* and the block 14, 16, 18.

FIG. 14 illustrates an intended follow through movement with uniform body rotation and arm swing so that there is no contact between the arms 56 and the block 14, 16, 18. FIG. 14A illustrates an unintended movement where there is too much arm swing and/or not enough body rotation such that there is contact between the rear arm 56*b* and the block 14, 16, 18. FIG. 14B illustrates a converse situation where there is too much body rotation and/or not enough arm swing such that there is contact between the front arm 56*a* and the block 14, 16, 18.

In either the putting or chipping strokes, the block 14, 16, 18 in the abdominal position 54 provides guidance to the golfer during either the putting or chipping stroke. As shown in the figures, in either type of stroke, the block 14, 16, 18 restricts swinging movement of the arms, which is desirable during both putting and chipping. Such strokes are preferably accomplished primarily with body rotation, involving minimal arm movement. If a user's putting or chipping stroke causes too much arm 56 contact with or movement of the block 14, 16, 18 during either putting or chipping, the user will know that the stroke involved too much or not enough arm movement. With the block 14, 16, 18 in the abdominal position 54 between the user's arms 56, the putting or chipping stroke is performed by rotating the body with minimal arm swing.

Figure 15:
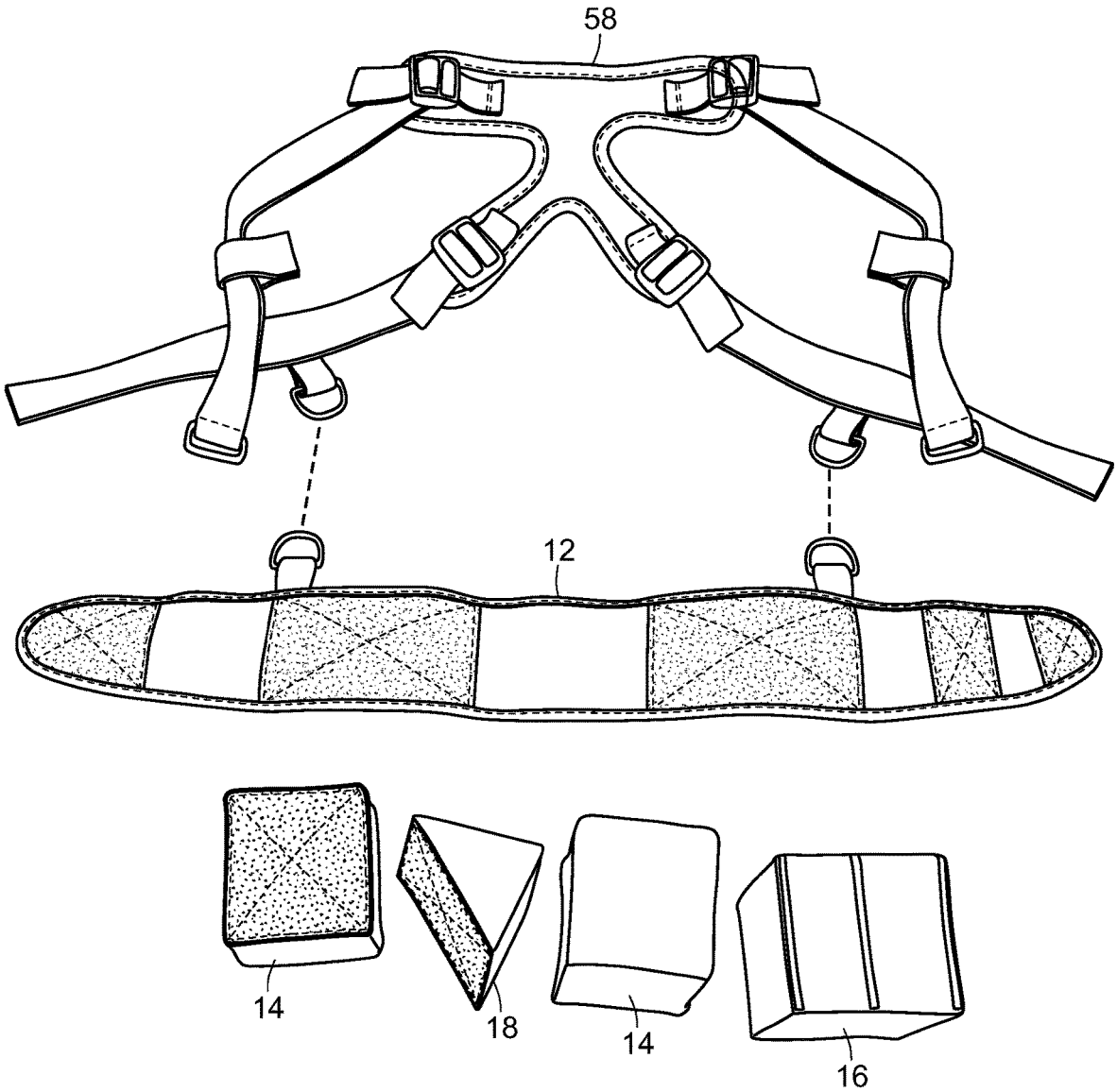
FIG. 15 is a perspective view of select assembled components of another preferred embodiment of the inventive sports swing training apparatus.

FIG. 15 illustrates and alternate embodiment of the system 10 that includes a shoulder harness 58 that is designed to attach to the waist wrap 12 and loop over the user's shoulders so as to maintain the waist wrap 12 in a desired position on the user's waist/torso 19. The shoulder harness includes adjustment straps to accommodate users of different sizes.

Although several embodiments have been described in detail for purposes of illustration, various modifications may be made without departing from the scope and spirit of the invention.

What is claimed is:

1. A system for training a user in a sports swing, comprising:

a waist wrap having an elongated shape configured for wrapping around a user's waist with an inside surface and an outside surface, wherein the inside surface has at least one waist securing region at one end of the elongated shape, and the outside surface has a plurality of securing regions along the elongated shape;

a first training block having a polygonal shape being positioned and configured on the waist wrap relative to a rear arm of the user to guide and restrict arm movement of the user during torso rotation in the sports swing, wherein an attachment face of the first training block has a matching securing region configured for selective attachment to one of the plurality of securing regions on the outside surface in a rear lateral position proximate to a rear lateral seam line;

a second training block having a polygonal shape being positioned and configured on the waist wrap relative to a front arm of the user to guide and restrict arm movement of the user during torso rotation in the sports swing, wherein an attachment face of the second training block has a matching securing region configured for selective attachment to one of the plurality of securing regions on the outside surface in a front lateral position proximate to a front lateral seam line; and wherein the first training block and the second training block guide and restrict arm movement of the user through obstructive interference between the first training block and the rear arm on one side and the second training block and the front arm on another side so as to train the user in a proper swing arc for the sports swing.

2. The system of claim 1, wherein at least one of the plurality of securing regions on the outside surface includes at least one waist securing matching region on an opposite end of the elongated shape from the waist securing region on the inside surface.

3. The system of claim 1, wherein the outside surface is covered from one end of the elongated shape to an opposite end with a securing region.

4. The system of claim 1, wherein the first training block has a cube shape and the second training block has a cube shape.

5. The system of claim 4, wherein the second training block has a guide face adjacent to the attachment face that includes three guidelines oriented perpendicular to the attachment face.

6. The system of claim 1, further comprising:

a third securing block having a polygonal shape and one attachment face having a matching securing region configured for selective attachment to one of the plurality of securing regions on the outside surface of the waist wrap; and a fourth securing block having a polygonal shape and one attachment face having a matching securing region configured for selective attachment to one of the plurality of securing regions on the outside surface of the waist wrap.

7. The system of claim 6, wherein the first securing block has a cube shape, the second securing block has a cube shape, the third securing block has a cube shape, and the fourth securing block has a triangular prism shape.

8. The system of claim 1, further comprising a shoulder harness attached to the waist wrap.

9. A process for training a user in a proper sports swing, comprising the steps of:

securing a waist wrap around a waist of the user;

attaching a training block to a securing region on an outside surface of the waist wrap wherein the securing region is in a rear lateral position proximate to a rear lateral seam line and a rear arm of the user;

practicing a sports swing of the user starting at address of a ball through backswing, downswing, impact, and follow through;

guiding and restricting arm movement during torso rotation by the user in the sports swing so as to avoid contact between the training block and the rear arm of the user; and maintaining proper arm position of the user throughout the sports swing, wherein proper arm position is indicated by an absence of contact between the rear arm of the user and the training block.

10. The process of claim 9, further comprising the step of attaching a second training block to a second securing region on the outside surface of the waist wrap, wherein the second securing region is in a front lateral position proximate to a front lateral seam line and a front arm of the user.

11. The process of claim 10, wherein the guiding and restricting step also includes avoiding contact between the front arm of the user and second training block, and wherein the maintaining step also includes an absence of contact between the second training block and the front arm of the user.

12. The process of claim 10, wherein the second training block attached to the front lateral position has a laterally extending guideline on an upward facing surface, further comprising the step of monitoring body rotation of the user by visually aligning the laterally extending guideline with the ball during the backswing.

13. The process of claim 12, wherein the second training block has three laterally extending guidelines sequentially across the upward facing surface, wherein the monitoring step includes visually aligning each of the three laterally extending guidelines in sequence with the ball throughout the backswing.

14. The process of claim 9, further comprising the step of attaching a third training block to a third securing region on the outside surface of the waist wrap, wherein the third securing region is in an abdominal securing position.

15. The process of claim 14, wherein the maintaining step involves an absence of contact between the third training block and both a front arm and the rear arm of the user.

16. The process of claim 9, further comprising the step of repeating the steps of practicing, guiding and restricting, and maintaining.

* * * * *